US009127336B2

(12) United States Patent
Miyanishi et al.

(10) Patent No.: US 9,127,336 B2
(45) Date of Patent: Sep. 8, 2015

(54) HOT-WORKING STEEL EXCELLENT IN MACHINABILITY AND IMPACT VALUE

(75) Inventors: Kei Miyanishi, Tokyo (JP); Masayuki Hashimura, Tokyo (JP); Atsushi Mizuno, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 12/306,782

(22) PCT Filed: Apr. 17, 2008

(86) PCT No.: PCT/JP2008/057880

§ 371 (c)(1),
(2), (4) Date: Dec. 29, 2008

(87) PCT Pub. No.: WO2008/130054

PCT Pub. Date: Oct. 30, 2008

(65) Prior Publication Data

US 2009/0311125 A1 Dec. 17, 2009

(30) Foreign Application Priority Data

Apr. 18, 2007 (JP) ..... 2007-109897

(51) Int. Cl.

| | |
|---|---|
| ***C22C 38/06*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |

(52) U.S. Cl.

CPC ..... *C22C 38/02* (2013.01); *C22C 38/001* (2013.01); *C22C 38/04* (2013.01); *C22C 38/06* (2013.01); *C22C 38/60* (2013.01)

(58) Field of Classification Search

None

See application file for complete search history.

(56) References Cited

U.S. PATENT DOCUMENTS

| | | | | |
|---|---|---|---|---|
| 3,155,496 | A | 11/1964 | Nakamura | |
| 6,966,955 | B2 * | 11/2005 | Choi et al. | 148/328 |
| 2003/0121577 | A1 | 7/2003 | Choi et al. | |
| 2005/0025658 | A1 * | 2/2005 | Matsui et al. | 420/124 |

FOREIGN PATENT DOCUMENTS

| | | | | |
|---|---|---|---|---|
| DE | 2146308 | * | 4/1972 | |
| JP | 2-267218 | A | 11/1990 | |
| JP | 11-293398 | * | 10/1999 | C22C 38/00 |
| JP | 11-323487 | * | 10/1999 | C22C 38/00 |
| JP | 2003-27135 | A | 1/2003 | |

(Continued)

OTHER PUBLICATIONS

Machine translation of Okonogi et al, JP 2004-250767 (2003).*

(Continued)

*Primary Examiner* — Yoshitoshi Takeuchi

(74) *Attorney, Agent, or Firm* — Birch, Stewart, Kolasch & Birch, LLP

(57) ABSTRACT

Provided is a hot-working steel excellent in machinability and impact value comprising, in mass %, C: 0.06 to 0.85%, Si: 0.01 to 1.5%, Mn: 0.05 to 2.0%, P: 0.005 to 0.2%, S: 0.001 to 0.35%, and Al: 0.06 to 1.0% and N: 0.016% or less, in contents satisfying $Al \times N \times 10^5 \leq 96$, and a balance of Fe and unavoidable impurities, total volume of AlN precipitates of a circle-equivalent diameter exceeding 200 nm accounting for 20% or less of total volume of all AlN precipitates.

10 Claims, 10 Drawing Sheets

(56) References Cited

FOREIGN PATENT DOCUMENTS

| | | | | | |
|---|---|---|---|---|---|
| JP | 2004-250767 | * | 2/2003 | ..... | C22C 38/00 |
| JP | 2003-342691 | A | 12/2003 | | |
| JP | 2006-77274 | A | 3/2006 | | |
| JP | 2006-183141 | * | 7/2006 | ..... | C21D 1/18 |
| KR | 10-2002-0046577 | A | 6/2002 | | |

OTHER PUBLICATIONS

English translation of 11-293398 (1999).*
English translation of JP 11-323487 (1999).*
English translation of JP 2006-183141 (2006).*

* cited by examiner

HOT-WORKING STEEL EXCELLENT IN MACHINABILITY AND IMPACT VALUE

FIELD OF THE INVENTION

This invention relates to a hot-working steel excellent in machinability and impact value, particularly a hot-rolling or hot-forging steel (combined under the term "hot-working steel") for machining.

DESCRIPTION OF THE RELATED ART

Although recent years have seen the development of steels of higher strength, there has concurrently emerged a problem of declining machinability. An increasing need is therefore felt for the development of steels that maintain excellent strength without experiencing a decline in machining performance. Addition of machinability-enhancing elements such as S, Pb and Bi is known to be effective for improving steel machinability. However, while Pb and Bi are known to improve machinability and to have relatively little effect on forgeability, they are also known to degrade strength properties.

Moreover, Pb is being used in smaller quantities these days owing to the tendency to avoid use because of concern about the load Pb puts on the natural environment. S improves machinability by forming inclusions, such as MnS, that soften in a machining environment, but MnS grains are larger than the those of Pb and the like, so that it readily becomes a stress concentration raiser. Of particular note is that at the time of elongation by forging or rolling, MnS produces anisotropy, which makes the steel extremely weak in a particular direction. It also becomes necessary to take such anisotropy into account during steel design. When S is added, therefore, it becomes necessary to utilize a technique for reducing the anisotropy.

Achievement of good strength properties and machinability simultaneously has thus been difficult because addition of elements effective for improving machinability degrade impact properties. Further technical innovation is therefore necessary for enabling attainment of desired steel machinability and strength properties at the same time.

A machine structural steel has been developed for prolonging of cutting tool life by, for example, incorporating a total of 0.005 mass % or greater of at least one member selected from among solute V, solute Nb and solute Al, and further incorporating 0.001% or greater of solute N, thereby enabling nitrides formed by machining heat during machining to adhere to the tool to function as a tool protective coating (see, for example, Japanese Patent Publication (A) No. 2004-107787).

In addition, there has been proposed a machine structural steel that achieves improved shavings disposal and mechanical properties by defining C, Si, Mn, S and Mg contents, defining the ratio of Mg content to S content, and optimizing the aspect ratio and number of sulfide inclusions in the steel (see Japanese Patent No. 3706560). The machine structural steel taught by Patent No. 3706560 prescribes the content of Mg as 0.02% or less (not including 0%) and the content of Al, when included, as 0.1% or less.

SUMMARY OF THE INVENTION

However, the foregoing existing technologies have the following drawbacks. The steel taught by Japanese Patent Publication (A) No. 2004-107787 is liable not to give rise to the aforesaid phenomenon unless the amount of heat produced by the machining exceeds a certain level. The machining speed must therefore be somewhat high to realize the desired effect, so the invention has a problem in the point that the effect cannot be anticipated in the low speed range. Japanese Patent No. 3706560 is totally silent regarding the strength properties of the steel it teaches. Moreover, the steel of this patent is incapable of achieving adequate strength properties because it gives no consideration to machine tool life or impact properties.

The present invention was achieved in light of the foregoing problems and has as its object to provide hot-working steel that has good machinability over a broad range of machining speeds and also has excellent impact properties.

The inventors discovered that a steel having good machinability and impact value can be obtained by establishing an optimum Al content, limiting N content, and limiting the coarse AlN precipitate fraction. They accomplished the present invention based on this finding.

The hot-working steel excellent in machinability and impact value according the present invention has a chemical composition comprising, in mass %, C: 0.06 to 0.85%,
Si: 0.01 to 1.5%,
Mn: 0.05 to 2.0%,
P: 0.005 to 0.2%,
S: 0.001 to 0.35%,
Al: 0.06 to 1.0% and N: 0.016% or less, in contents satisfying $Al \times N \times 10^5 \leq 96$, and
a balance of Fe and unavoidable impurities,
total volume of AlN precipitates of a circle-equivalent diameter exceeding 200 nm accounting for 20% or less of total volume of all AlN precipitates.

The hot-working steel can further comprise, in mass %, Ca: 0.0003 to 0.0015%.

The hot-working steel can further comprise, in mass %, one or more elements selected from the group consisting of Ti: 0.001 to 0.1%, Nb: 0.005 to 0.2%, W: 0.01 to 1.0%, and V: 0.01 to 1.0%.

The hot-working steel can further comprise, in mass %, one or more elements selected from the group consisting of Mg: 0.0001 to 0.0040%, Zr: 0.0003 to 0.01%, and REMs: 0.0001 to 0.015%.

The hot-working steel can further comprise, in mass %, one or more elements selected from the group consisting of Sb: 0.0005% to less than 0.0150%, Sn: 0.005 to 2.0%, Zn: 0.0005 to 0.5%, B: 0.0005 to 0.015%, Te: 0.0003 to 0.2%, Bi: 0.005 to 0.5%, and Pb: 0.005 to 0.5%.

The hot-working steel can further comprise, in mass %, one or two elements selected from the group consisting of Cr: 0.01 to 2.0% and Mo: 0.01 to 1.0%.

The hot-working steel can further comprise, in mass %, one or two elements selected from the group consisting of Ni: 0.05 to 2.0% and Cu: 0.01 to 2.0%.

DETAILED DESCRIPTION OF THE INVENTION

Figure 1:
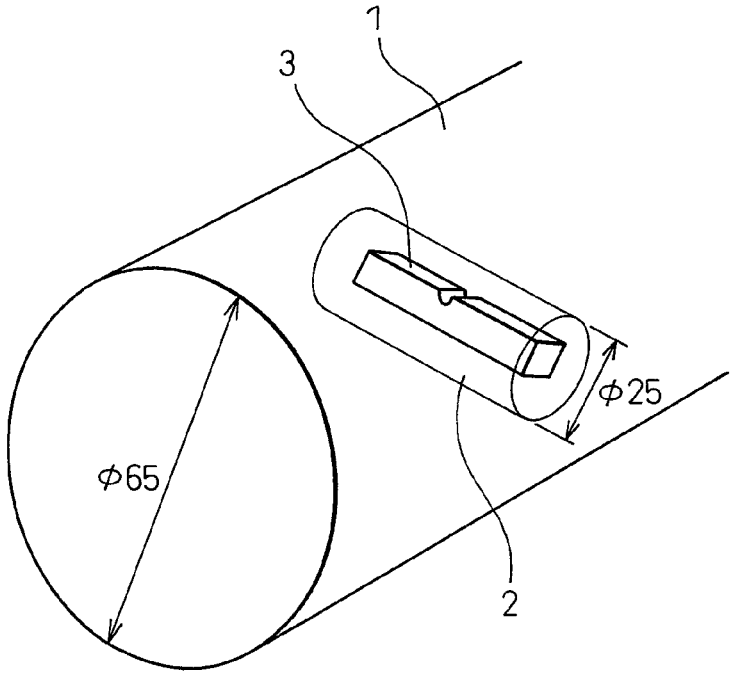
FIG. 1 is a diagram showing the region from which a Charpy impact test piece was cut in Example 1.

Preferred embodiments of the present invention are explained in detail in the following.

In the hot-working steel excellent in machinability and impact value according to the present invention, the aforesaid problems are overcome by regulating the amounts of added Al and N in the chemical composition of the steel to the ranges of Al: 0.06 to 1.0% and N: 0.016% or less, and regulating the total volume of AlN precipitates of a circle-equivalent diameter exceeding 200 nm to 20% or less of the total volume of all AlN precipitates.

As a result, machinability is improved by establishing an optimum content of solute Al, which produces a matrix embrittling effect, so as to attain a machinability improving effect without experiencing the impact property degradation experienced with the conventional free-cutting elements S and Pb.

When the total volume of AlN precipitates of a circle-equivalent diameter exceeding 200 nm exceeds 20% of the total volume of all AlN precipitates, mechanical cutting tool wear by coarse AlN precipitates is pronounced, making it impossible to realize a machinability improving effect.

The contents (mass %) of the chemical constituents of the hot-working steel of the invention will first be explained.

C: 0.06 to 0.85%

C has a major effect on the fundamental strength of the steel. When the C content is less than 0.06%, adequate strength cannot be achieved, so that larger amounts of other alloying elements must be incorporated. When C content exceeds 0.85%, machinability declines markedly because carbon concentration becomes nearly hypereutectoid to produce heavy precipitation of hard carbides. In order to achieve sufficient strength, the present invention therefore defines C content as 0.6 to 0.85%.

Si: 0.01 to 1.5%

Si is generally added as a deoxidizing element but also contributes to ferrite strengthening and temper-softening resistance. When Si content is less than 0.01%, the deoxidizing effect is insufficient. On the other hand, an Si content in excess of 1.5% degrades the steel's embrittlement and other properties and also impairs machinability. Si content is therefore defined as 0.01 to 1.5%.

Mn: 0.05 to 2.0%

Mn is required for its ability to fix and disperse S in the steel in the form of MnS and also, by dissolving into the matrix, to improve hardenability and ensure good strength after quenching. When Mn content is less than 0.05%, the steel is embrittled because S therein combines with Fe to form FeS. When Mn content is high, specifically when it exceeds 2.0%, base metal hardness increases to degrade cold workability, while its strength and hardenability improving effects saturate. Mn content is therefore defined as 0.05 to 2.0%.

P: 0.005 to 0.2%

P has a favorable effect on machinability but the effect is not obtained at a P content of less than 0.005%. When P content is high, specifically when it exceeds 0.2%, base metal hardness increases to degrade not only cold workability but also hot workability and casting properties. P content is therefore defined as 0.005 to 0.2%.

S: 0.001 to 0.35%

S combines with Mn to produce MnS that is present in the steel in the form of inclusions. MnS improves machinability but S must be added to a content of 0.001% or greater for achieving this effect to a substantial degree. When S content exceeds 0.35%, it saturates in effect and also manifestly lowers strength. In the case of adding S to improve machinability, therefore, the S content is made 0.001 to 0.35%.

Al: 0.06 to 1.0%

Al not only forms oxides but also promotes precipitation of fine AlN precipitates that contribute to grain size control, and further improve machinability by passing into solid solution. Al must be added to a content of 0.06% or greater in order to form solute Al in an amount sufficient to enhance machinability. When Al content exceeds 1.0%, it greatly modifies heat treatment properties and degrades machinability by increasing steel hardness. Al content is therefore defined as 0.06 to 1.0%. The lower limit of content is preferably greater than 0.1%.

N: 0.016% or Less

N combines with Al and other nitride-forming elements, and is therefore present both in the form of nitrides and as solute N. The upper limit of N content is defined 0.016% because at higher content it degrades machinability by causing nitride enlargement and increasing solute N content, and also leads to the occurrence of defects and other problems during rolling. The preferred upper limit of N content is 0.010%.

The hot-working steel of the present invention can contain Ca in addition to the foregoing components.

Ca: 0.0003 to 0.0015%

Ca is a deoxidizing element that forms oxides. In the hot-working steel of the present invention, which has a total Al content of 0.06 to 1.0%, Ca forms calcium aluminate ($CaOAl_2O_3$). As $CaOAl_2O_3$ is an oxide having a lower melting point than $Al_2O_3$, it improves machinability by constituting a tool protective film during high-speed cutting. However, this machinability-improving effect is not observed when the Ca content is less than 0.0003%. When Ca content exceeds 0.0015%, CaS forms in the steel, so that machinability is instead degraded. Therefore, when Ca is added, its content is defined as 0.0003 to 0.0015%.

When the hot-working steel of the present invention needs to be given high strength by forming carbides, it can include in addition to the foregoing components one or more elements selected from the group consisting of Ti: 0.001 to 0.1%, Nb: 0.005 to 0.2%, W: 0.01 to 1.0%, and V: 0.01 to 1.0%.

Ti: 0.001 to 0.1%

Ti forms carbonitrides that inhibit austenite grain growth and contribute to strengthening. It is used as a grain size control element for preventing grain coarsening in steels requiring high strength and steels requiring low strain. Ti is also a deoxidizing element that improves machinability by forming soft oxides. However, these effects of Ti are not observed at a content of less than 0.001%, and when the content exceeds 0.1%, Ti has the contrary effect of degrading mechanical properties by causing precipitation of insoluble coarse carbonitrides that cause hot cracking. Therefore, when Ti is added, its content is defined as 0.001 to 0.1%.

Nb: 0.005 to 0.2%

Nb also forms carbonitrides. As such, it is an element that contributes to steel strength through secondary precipitation hardening and to austenite grain growth inhibition and strengthening. Ti is therefore used as a grain size control element for preventing grain coarsening in steels requiring high strength and steels requiring low strain. However, no high strength imparting effect is observed at an Nb content of less than 0.005%, and when Nb is added to a content exceeding 0.2%, it has the contrary effect of degrading mechanical properties by causing precipitation of insoluble coarse carbonitrides that cause hot cracking. Therefore, when Nb is added, its content is defined as 0.005 to 0.2%.

W: 0.01 to 1.0%

W is also an element that forms carbonitrides and can strengthen the steel through secondary precipitation hardening. However, no high strength imparting effect is observed when W content is less than 0.01%, Addition of W in excess of 1.0% has the contrary effect of degrading mechanical properties by causing precipitation of insoluble coarse carbonitrides that cause hot cracking. Therefore, when W is added, its content is defined as 0.01 to 1.0%.

V: 0.01 to 1.0%.

V is also an element that forms carbonitrides and can strengthen the steel through secondary precipitation hardening. It is suitably added to steels requiring high strength. However, no high strength imparting effect is observed when V content is less than 0.01%. Addition of V in excess of 1.0% has the contrary effect of degrading mechanical properties by causing precipitation of insoluble coarse carbonitrides that cause hot cracking. Therefore, when V is added, its content is defined as 0.01 to 1.0%.

When the hot-rolling steel or hot-forging steel of the present invention is subjected to deoxidization control for controlling sulfide morphology, it can comprise in addition to the foregoing components one or more elements selected from the group consisting of Mg: 0.0001 to 0.0040%, Zr: 0.0003 to 0.01%, and REMs: 0.0001 to 0.015%.

Mg: 0.0001 to 0.0040%

Mg is a deoxidizing element that forms oxides in the steel. When Al deoxidization is adopted, Mg reforms $Al_2O_3$, which impairs machinability, into relatively soft and finely dispersed MgO and $Al_2O_3$—MgO. Moreover, its oxide readily acts as a precipitation nucleus of MnS and thus works to finely disperse MnS. However, these effects are not observed at an Mg content of less than 0.0001%. Moreover, while Mg acts to make MnS spherical by forming a metal-sulfide complex therewith, excessive Mg addition, specifically addition to a content of greater than 0.0040%, degrades machinability by promoting simple MgS formation. Therefore, when Mg is added, its content is defined as to 0.0001 to 0.0040%.

Zr: 0.0003 to 0.01%.

Zr is a deoxidizing element that forms an oxide in the steel. The oxide is thought to be $ZrO_2$, which acts as a precipitation nucleus for MnS. Since addition of Zr therefore increases the number of MnS precipitation sites, it has the effect of uniformly dispersing MnS. Moreover, Zr dissolves into MnS to form a metal-sulfide complex therewith, thus decreasing MnS deformation, and therefore also works to inhibit MnS grain elongation during rolling and hot-forging. In this manner, Zr effectively reduces anisotropy. But no substantial effect in these respects is observed at a Zr content of less than 0.0003%. On the other hand, addition of Zr in excess of 0.01% radically degrades yield. Moreover, by causing formation of large quantities of $ZrO_2$, ZrS and other hard compounds, it has the contrary effect of degrading mechanical properties such as machinability, impact value, fatigue properties and the like. Therefore, when Zr is added, its content is defined as to 0.0003 to 0.01%.

REMs: 0.0001 to 0.015%

REMs (rare earth metals) are deoxidizing elements that form low-melting-point oxides that help to prevent nozzle clogging during casting and also dissolve into or combine with MnS to decrease MnS deformation, thereby acting to inhibit MnS shape elongation during rolling and hot-forging. REMs thus serve to reduce anisotropy. However, this effect does not appear at an REM total content of less than 0.0001%. When the content exceeds 0.015%, machinability is degraded owing to the formation of large amounts of REM sulfides. Therefore, when REMs are added, their content is defined as 0.0001 to 0.015%.

When the hot-working steel of the present invention is to be improved in machinability, it can include in addition to the foregoing components one or more elements selected from the group consisting of Sb: 0.0005% to less than 0.0150%, Sn: 0.005 to 2.0%, Zn: 0.0005 to 0.5%, B: 0.0005 to 0.015%, Te: 0.0003 to 0.2%, Bi: 0.005 to 0.5%, and Pb: 0.005 to 0.5%.

Sb: 0.0005% to Less Than 0.0150%

Sb improves machinability by suitably embrittling ferrite. This effect of Sb is pronounced particularly when solute Al content is high but is not observed when Sb content is less than 0.0005%. When Sb content is high, specifically when it reaches 0.0150% or greater, Sb macro-segregation becomes excessive, so that the impact value of the steel declines markedly. Sb content is therefore defined as 0.0005% or greater and less than 0.0150%.

Sn: 0.005 to 2.0%

Sn extends tool life by embrittling ferrite and also improves surface roughness. These effects are not observed when the Sn content is less than 0.005%, and the effects saturate when Sn is added in excess of 2.0%. Therefore, when Sn is added, its content is defined as 0.005 to 2.0%.

Zn: 0.0005 to 0.5%

Zn extends tool life by embrittling ferrite and also improves surface roughness. These effects are not observed when the Zn content is less than 0.0005%, and the effects saturate when Zn is added in excess of 0.5%. Therefore, when Zn is added, its content is defined as 0.0005 to 0.5%.

B: 0.0005 to 0.015%

B, when in solid solution, has a favorable effect on grain boundary strength and hardenability. When it precipitates, it precipitates as BN and therefore helps to improve machinability. These effects are not notable at a B content of less than 0.0005%. When B is added to a content of greater than 0.015%, the effects saturate and mechanical properties are to the contrary degraded owing to excessive precipitation of BN. Therefore, when B is added, its content is defined as 0.0005 to 0.015%.

Te: 0.0003 to 0.2%

Te improves machinability. It also forms MnTe and, when co-present with MnS, decreases MnS deformation, thereby acting to inhibit MnS shape elongation. Te is thus an element effective for reducing anisotropy. These effects are not observed when Te content is less than 0.0003%, and when the content thereof exceeds 0.2%, the effects saturate and hot-rolling ductility declines, increasing the likelihood of flaws. Therefore, when Te is added, its content is defined as: 0.0003 to 0.2%.

Bi: 0.005 to 0.5%

Bi improves machinability. This effect is not observed when Bi content is less than 0.005%. When it exceeds 0.5%, machinability improvement saturates and hot-rolling ductility declines, increasing the likelihood of flaws. Therefore, when Bi is added, its content is defined as 0.005 to 0.5%.

Pb: 0.005 to 0.5%

Pb improves machinability. This effect is not observed when Pb content is less than 0.005%. When it exceeds 0.5%, machinability improvement saturates and hot-rolling ductility declines, increasing the likelihood of flaws. Therefore, when Pb is added, its content is defined as 0.005 to 0.5%.

When the hot-rolling steel or hot-forging steel of the present invention is to be imparted with strength by improving its hardenability and/or temper-softening resistance, it can include in addition to the foregoing components one or two elements selected from the group consisting of Cr: 0.01 to 2.0% and Mo: 0.01 to 1.0%.

Cr: 0.01 to 2.0%

Cr improves hardenability and also imparts temper-softening resistance. It is therefore added to a steel requiring high strength. These effects are not obtained at a Cr content of less than 0.01%. When Cr content is high, specifically when it exceeds 2.0%, the steel is embrittled owing to formation of Cr carbides. Therefore, when Cr is added, its content is defined as 0.01 to 2.0%.

Mo: 0.01 to 1.0%

Mo imparts temper-softening resistance and also improves hardenability. It is therefore added to a steel requiring high strength. These effects are not obtained at an Mo content of less than 0.01%. When Mo is added in excess of 1.0%, its effects saturate. Therefore, when Mo is added, its content is defined as 0.01 to 1.0%.

When the hot-working steel of the present invention is to be subjected to ferrite strengthening, it can include in addition to the foregoing components one or two elements selected from the group consisting of Ni: 0.05 to 2.0% and Cu: 0.01 to 2.0%.

Ni: 0.05 to 2.0%

Ni strengthens ferrite, thereby improving ductility, and is also effective for hardenability improvement and anticorrosion improvement. These effects are not observed at an Ni content of less than 0.05%. When Ni is added in excess of 2.0%, mechanical property improving effect saturates and machinability is degraded. Therefore, when Ni is added, its content is defined as 0.05 to 2.0%.

Cu: 0.01 to 2.0%

Cu strengthens ferrite and is also effective for hardenability improvement and anticorrosion improvement. These effects are not observed a Cu content of less than 0.01%. When Cu is added in excess of 2.0%, mechanical property improving effect saturates. Therefore, when Cu is added, its content is defined as 0.01 to 2.0%. A particular concern regarding Cu is that its effect of lowering hot-rollability may lead to occurrence of flaws during rolling. Cu is therefore preferably added simultaneously with Ni.

The reason for making the total volume of AlN precipitates of a circle-equivalent diameter exceeding 200 nm not greater than 20% of the total volume of all AlN precipitates will now be explained.

When the total volume of AlN precipitates of a circle-equivalent diameter exceeding 200 nm is greater than 20% of the total volume of all AlN precipitates, mechanical cutting tool wear by coarse AlN precipitates is pronounced while no machinability-improving attributable to increase in solute Al is observed. The total volume of AlN precipitates of a circle-equivalent diameter exceeding 200 nm is therefore made 20% or less, preferably 15% or less and more preferably 10% or less, of the total volume of all AlN precipitates.

The vol % of AlN precipitates of a circle-equivalent diameter exceeding 200 nm can be measured by the replica method using a transmission electron microscope. For example, the method is carried out by using contiguous photographs of 400,000× equivalent magnification to observe AlN precipitates of 10 nm or greater diameter in 20 or more randomly selected 1,000 $\mu m^2$ fields, calculating the total volumes of AlN precipitates of a circle-equivalent diameter exceeding 200 nm and of all AlN precipitates, and then calculating [(Total volume of AlN precipitates of a circle-equivalent diameter exceeding 200 nm/Total volume of all AlN precipitates)×100].

In order to make the total volume of AlN precipitates of a circle-equivalent diameter exceeding 200 nm equal to 20% or less the total volume of all AlN precipitates, it is necessary to thoroughly place AlN in solid solution and regulate the heating temperature before hot-rolling or hot-forging so as to minimize un-solutionized AlN.

The inventors conducted the following experiment to test their hypothesis that the amount of un-solutionized AlN is related to the product of the steel Al and N contents and to the heating temperature before hot working.

Ten steels of the following chemical composition were prepared to have different products of Al times N, forged to ϕ65, heated to 1,210° C., and examined for AlN precipitates:

chemical composition, in mass %, C: 0.44 to 0.46%, Si: 0.23 to 0.26%, Mn: 0.78 to 0.82%, P: 0.013 to 0.016%, S: 0.02 to 0.06%, Al: 0.06 to 0.8%, N: 0.0020 to 0.020% the balance of Fe and unavoidable impurities. AlN precipitates were observed with a transmission electron microscope by the replica method, and the AlN precipitate volume fractions were determined by the method explained above.

The total volume of AlN precipitates of a circle-equivalent diameter exceeding 200 nm being 20% or less of the total volume of all AlN precipitates was evaluated as Good (designated by they symbol ○ in FIG. 11) and the same being greater than 20% thereof was evaluated Poor (designated by the symbol x).

Figure 11:
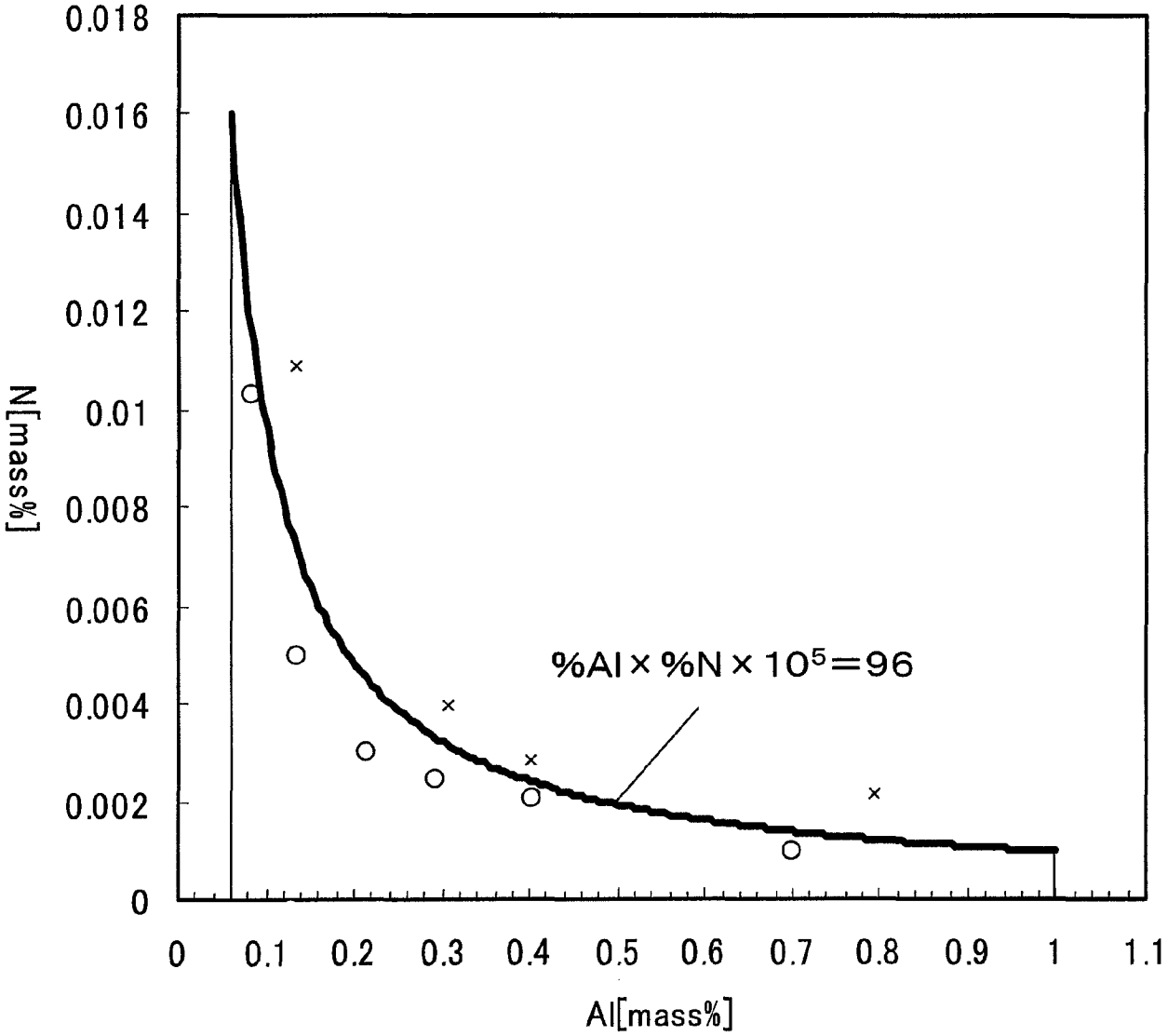
FIG. 11 is a diagram showing how occurrence of AlN precipitates of a circle-equivalent diameter exceeding 200 nm varied with product of steel Al and N contents.

As can be seen from the results shown in FIG. 11, it was found that the percentage by volume of coarse AlN precipitates having a circle-equivalent diameter of 200 nm relative to all AlN precipitates could be made 20% or less by satisfying Eq. (1) below and using a heating temperature of 1,210° C. or greater:

$$(\%\ Al)\times(\%\ N)\times10^5\leq96 \quad (1),$$

where % Al and % N are the Al and N contents (mass %) of the steel.

In other words, the total volume of AlN precipitates of a circle-equivalent diameter exceeding 200 nm can be made 20% or less, preferably 15% or less and more preferably 10% or less, of the total volume of all AlN precipitates by satisfying Eq. 1 and using a heating temperature of 1,210° C. or greater, preferably 1,230° C. or greater, and more preferably 1,250° C. or greater.

As is clear from the foregoing, the present invention enables provision of a hot-working steel (hot-rolling steel or hot-forging steel) wherein content of machinability-enhancing solute Al is increased while inhibiting generation of coarse AlN precipitates, thereby achieving better machinability than conventional hot-rolling and hot-forging steels without impairing impact property. Moreover, owing to the fact that a steel good in impact property generally has a low cracking rate during hot-rolling and hot-forging, the invention steel effectively enables machinability improvement while maintaining good productivity during hot-rolling and hot-forging.

Examples

The effects of the present invention are concretely explained below with reference to Examples and Comparative Examples.

The invention can be applied widely to cold forging steels, untempered steels, tempered steels and so on, irrespective of what heat treatment is conducted following hot-rolling or hot-forging. The effect of applying the present invention will therefore be concretely explained with regard to five types of steel differing markedly in basic composition and heat treatment and also differing in fundamental strength and heat-treated structure.

However, the explanation will be made separately for seven examples because machinability and impact property are strongly influenced by differences in fundamental strength and heat-treated structure.

First Set of Examples

In the First Set of Examples, medium-carbon steels were examined for machinability after normalization and for impact value after normalization and oil quenching-tempering. In this set of Examples, steels of the compositions shown in Table 1-1, 150 kg each, were produced in a vacuum furnace, hot-forged under the heating temperatures shown in Table 1-3, and elongation-forged into 65-mm diameter cylindrical rods. The properties of the Example steels were evaluated by subjecting them to machinability testing, Charpy impact testing, and AlN precipitate observation by the methods set out below.

TABLE 1-1

| | | Chemical composition (mass %) | | | | | | | | | | | | |
|---|---|---|---|---|---|---|---|---|---|---|---|---|---|---|
| * | No. | C | Si | Mn | P | S | Al | N | Ca | Ti | Nb | W | V | Mg |
| Inv | 1 | 0.46 | 0.23 | 0.75 | 0.013 | 0.010 | 0.130 | 0.0070 | | | | | | |
| Inv | 2 | 0.46 | 0.23 | 0.76 | 0.011 | 0.011 | 0.200 | 0.0045 | | | | | | |
| Inv | 3 | 0.48 | 0.19 | 0.79 | 0.012 | 0.024 | 0.110 | 0.0065 | | | | | | |
| Inv | 4 | 0.44 | 0.20 | 0.78 | 0.010 | 0.028 | 0.198 | 0.0046 | | | | | | |
| Inv | 5 | 0.45 | 0.21 | 0.76 | 0.011 | 0.052 | 0.065 | 0.0081 | | | | | | |
| Inv | 6 | 0.46 | 0.25 | 0.70 | 0.015 | 0.054 | 0.125 | 0.0055 | | | | | | |
| Inv | 7 | 0.46 | 0.23 | 0.77 | 0.010 | 0.060 | 0.210 | 0.0045 | | | | | | |
| Inv | 8 | 0.47 | 0.21 | 0.75 | 0.011 | 0.091 | 0.103 | 0.0051 | | | | | | |
| Inv | 9 | 0.46 | 0.25 | 0.76 | 0.013 | 0.147 | 0.101 | 0.0052 | | | | | | |
| Inv | 10 | 0.47 | 0.25 | 0.74 | 0.013 | 0.026 | 0.077 | 0.0088 | 0.0009 | | | | | |
| Inv | 11 | 0.48 | 0.25 | 0.77 | 0.014 | 0.030 | 0.102 | 0.0046 | | 0.01 | 0.01 | 0.01 | | |
| Inv | 12 | 0.45 | 0.21 | 0.75 | 0.015 | 0.021 | 0.113 | 0.0075 | | | | | | 0.0018 |
| Inv | 13 | 0.48 | 0.24 | 0.77 | 0.012 | 0.020 | 0.088 | 0.0055 | | | | | | |
| Inv | 14 | 0.44 | 0.25 | 0.80 | 0.011 | 0.024 | 0.103 | 0.0053 | 0.0008 | 0.01 | 0.02 | | | 0.0015 |
| Inv | 15 | 0.45 | 0.26 | 0.81 | 0.014 | 0.051 | 0.081 | 0.0045 | | | | | | |
| Comp | 16 | 0.46 | 0.24 | 0.78 | 0.010 | 0.015 | 0.025 | 0.0052 | | | | | | |
| Comp | 17 | 0.48 | 0.23 | 0.75 | 0.013 | 0.013 | 0.210 | 0.0051 | | | | | | |
| Comp | 18 | 0.48 | 0.19 | 0.75 | 0.014 | 0.015 | 0.132 | 0.0072 | | | | | | |
| Comp | 19 | 0.48 | 0.25 | 0.78 | 0.014 | 0.030 | 0.030 | 0.0034 | | | | | | |
| Comp | 20 | 0.48 | 0.20 | 0.76 | 0.013 | 0.022 | 0.222 | 0.0048 | | | | | | |
| Comp | 21 | 0.48 | 0.22 | 0.71 | 0.012 | 0.030 | 0.113 | 0.0078 | | | | | | |
| Comp | 22 | 0.48 | 0.24 | 0.70 | 0.010 | 0.045 | 0.041 | 0.0057 | | | | | | |
| Comp | 23 | 0.45 | 0.20 | 0.78 | 0.015 | 0.048 | 0.209 | 0.0067 | | | | | | |
| Comp | 24 | 0.44 | 0.23 | 0.71 | 0.010 | 0.057 | 0.123 | 0.0077 | | | | | | |
| Comp | 25 | 0.47 | 0.20 | 0.76 | 0.014 | 0.091 | 0.030 | 0.0052 | | | | | | |
| Comp | 26 | 0.48 | 0.19 | 0.77 | 0.013 | 0.093 | 0.221 | 0.0051 | | | | | | |
| Comp | 27 | 0.47 | 0.20 | 0.74 | 0.013 | 0.094 | 0.154 | 0.0059 | | | | | | |
| Comp | 28 | 0.47 | 0.19 | 0.78 | 0.011 | 0.137 | 0.008 | 0.0049 | | | | | | |
| Comp | 29 | 0.46 | 0.25 | 0.74 | 0.013 | 0.133 | 0.228 | 0.0058 | | | | | | |
| Comp | 30 | 0.46 | 0.24 | 0.77 | 0.015 | 0.136 | 0.079 | 0.0106 | | | | | | |

| * | No. | Zr | Rem | Sb | Sn | Zn | B | Te | Cr | Mo | Cu | Ni | Pb | Bi |
|---|---|---|---|---|---|---|---|---|---|---|---|---|---|---|
| Inv | 1 | | | | | | | | | | | | | |
| Inv | 2 | | | | | | | | | | | | | |
| Inv | 3 | | | | | | | | | | | | | |
| Inv | 4 | | | | | | | | | | | | | |
| Inv | 5 | | | | | | | | | | | | | |
| Inv | 6 | | | | | | | | | | | | | |
| Inv | 7 | | | | | | | | | | | | 0.1 | 0.05 |
| Inv | 8 | | | | | | | | | | | | | |
| Inv | 9 | | | | | | | | | | | | | |
| Inv | 10 | | | | | | | | | | | | | |
| Inv | 11 | | | | | | | | | | | | | |
| Inv | 12 | 0.01 | 0.0011 | | | | | | | | | | | |
| Inv | 13 | | | | | | | | | | 0.1 | 0.06 | | |
| Inv | 14 | | | | 0.03 | 0.002 | 0.001 | 0.001 | | 0.03 | 0.1 | | | |
| Inv | 15 | | | 0.0026 | | | | | | | | | | |
| Comp | 16 | | | | | | | | | | | | | |
| Comp | 17 | | | | | | | | | | | | | |
| Comp | 18 | | | | | | | | | | | | | |
| Comp | 19 | | | | | | | | | | | | | |
| Comp | 20 | | | | | | | | | | | | | |
| Comp | 21 | | | | | | | | | | | | | |
| Comp | 22 | | | | | | | | | | | | | |
| Comp | 23 | | | | | | | | | | | | | |

TABLE 1-1-continued

| | | Chemical composition (mass %) |
|---|---|---|
| Comp | 24 | |
| Comp | 25 | |
| Comp | 26 | |
| Comp | 27 | |
| Comp | 28 | |
| Comp | 29 | |
| Comp | 30 | |

* Inv: Invention Example
Comp: Comparative Example

Machinability Test

Machinability testing was conducted on the forged steels by first subjecting them to heat treatment for normalization consisting of holding under temperature condition of 850° C. for 1 hr followed by cooling, thereby adjusting HV10 hardness to within the range of 160 to 170. A machinability evaluation test piece was then cut from each heat-treated steel and the machinabilities of the Example and Comparative Example steels were evaluated by conducting drill boring testing under the cutting conditions shown in Table 1-2.

The maximum cutting speed VL1000 enabling cutting up to a cumulative hole depth of 1000 mm was used as the evaluation index in the drill boring test.

TABLE 1-2

| Cutting conditions | | Drill | | Other |
|---|---|---|---|---|
| Speed | 1-150 m/min | Drill diameter: ϕ3 mm | Hole depth | 9 mm |
| Feed | 0.25 mm/rev | NACHI ordinary drill | | |
| Cutting fluid | Water-soluble cutting oil | Overhang: 45 mm | Tool life | Until breakage |

NACHI ordinary drill: SD3.0 drill manufactured by Nachi Fujikoshi Corp. (hereinafter the same)

Charpy Impact Test

FIG. 1 is a diagram showing the region from which the Charpy impact test piece was cut. In the Charpy impact test, first, as shown in FIG. 1, a cylinder 2 measuring 25 mm in diameter was cut from each steel 1 heat-treated by the same method and under the same conditions as the aforesaid machinability test piece so that its axis was perpendicular to the elongation-forging direction of the steel 1. Next, each cylinder 2 was held under temperature condition of 850° C. for 1 hr, oil-quenched by cooling to 60° C., and further subjected to tempering with water cooling in which it was held under temperature condition of 550° C. for 30 min, thereby adjusting it to an Hv10 hardness within the range of 255 to 265. Next, the cylinder 2 was machined to fabricate a Charpy test piece 3 in conformance with JIS Z 2202, which was subjected to a Charpy impact test at room temperature in accordance with the method prescribed by JIS Z 2242. Absorbed energy per unit area (J/cm$^2$) was adopted as the evaluation index.

AlN Precipitate Observation

AlN precipitate observation was conducted by the transmission electron microscope replica method using a specimen cut from the Q region of a steel fabricated by the same method as that for the machinability evaluation test piece.

AlN precipitate observation was carried out for 20 randomly selected 1,000 μm$^2$ fields to determine the fraction (%) all AlN precipitates accounted for by AlN precipitates of a circle-equivalent diameter exceeding 200 nm.

The results of the foregoing tests are summarized in Table 1-3.

TABLE 1-3

| | No. | Al × N × 100000 | Heating temp (° C.) | AlN fraction (%) | VL1000 (m/min) | Impact value (J/cm2) |
|---|---|---|---|---|---|---|
| Invention Example | 1 | 91 | 1250 | 17.3 | 70 | 33 |
| Invention Example | 2 | 90 | 1250 | 16.9 | 67 | 35 |
| Invention Example | 3 | 72 | 1250 | 9.9 | 81 | 26 |
| Invention Example | 4 | 91 | 1250 | 17.3 | 80 | 26 |
| Invention Example | 5 | 53 | 1250 | 5.8 | 96 | 24 |
| Invention Example | 6 | 69 | 1250 | 9.8 | 95 | 23 |
| Invention Example | 7 | 95 | 1250 | 18.6 | 130 | 19 |
| Invention Example | 8 | 53 | 1250 | 5.7 | 113 | 17 |
| Invention Example | 9 | 53 | 1250 | 5.4 | 125 | 15 |
| Invention Example | 10 | 68 | 1250 | 9.6 | 82 | 27 |
| Invention Example | 11 | 47 | 1250 | 4.1 | 83 | 28 |
| Invention Example | 12 | 85 | 1250 | 15.0 | 80 | 27 |
| Invention Example | 13 | 48 | 1250 | 4.9 | 81 | 26 |
| Invention Example | 14 | 55 | 1250 | 5.6 | 95 | 27 |
| Invention Example | 15 | 36 | 1210 | 4.8 | 95 | 23 |
| Comparative Example | 16 | 13 | 1250 | 0.4 | 47 | 35 |
| Comparative Example | 17 | 107 | 1250 | 23.9 | 53 | 30 |
| Comparative Example | 18 | 95 | 1200 | 27.1 | 47 | 33 |
| Comparative Example | 19 | 10 | 1250 | 0.2 | 57 | 27 |
| Comparative Example | 20 | 107 | 1250 | 23.7 | 55 | 26 |
| Comparative Example | 21 | 88 | 1200 | 22.3 | 59 | 29 |
| Comparative Example | 22 | 23 | 1250 | 1.1 | 64 | 20 |
| Comparative Example | 23 | 140 | 1250 | 40.9 | 64 | 24 |
| Comparative Example | 24 | 95 | 1200 | 28.0 | 64 | 23 |
| Comparative Example | 25 | 16 | 1250 | 0.5 | 76 | 15 |
| Comparative Example | 26 | 113 | 1250 | 26.5 | 74 | 19 |

TABLE 1-3-continued

| | No. | Al × N × 100000 | Heating temp (° C.) | AlN fraction (%) | VL1000 (m/min) | Impact value (J/cm2) |
|---|---|---|---|---|---|---|
| Comparative Example | 27 | 91 | 1200 | 27.5 | 73 | 19 |
| Comparative Example | 28 | 4 | 1250 | 0.0 | 81 | 13 |
| Comparative Example | 29 | 132 | 1250 | 36.4 | 82 | 13 |
| Comparative Example | 30 | 84 | 1200 | 21.1 | 86 | 14 |

In Tables 1-1 and 1-3, the Steels No. 1 to No. 15 are Examples of the present invention and the Steels No. 16 to No. 30 are Comparative Example steels.

Figure 4:
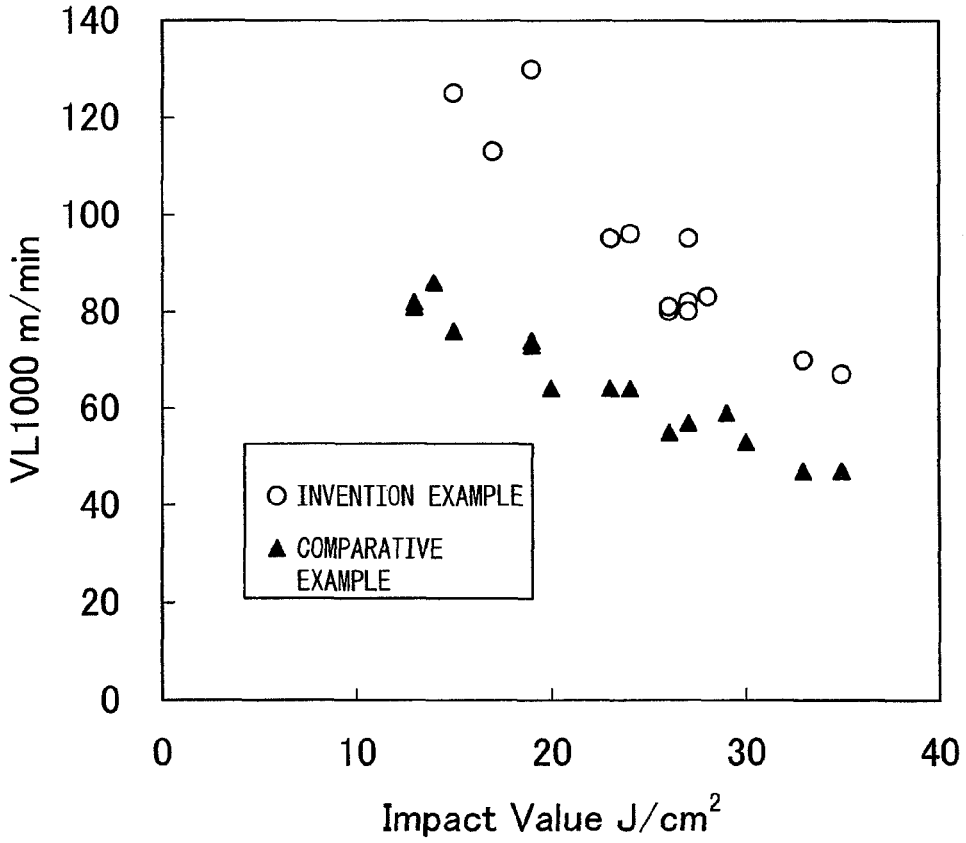
FIG. 4 is a diagram showing the relationship between impact value and machinability in Example 1.

As shown in Table 1-3, the steels of Examples No 1 to No. 15 exhibited well-balanced evaluation indexes, namely VL1000 and impact value (absorbed energy), but the steels of the Comparative Examples 16 to 30 were each inferior to the Example steels in at least one of the properties, so that the balance between VL1000 and impact value (absorbed energy) was poor. (See FIG. 4.)

Specifically, the steels of Comparative Examples Nos. 16, 19, 22, 25 and 28 had Al contents below the range prescribed by the present invention and were therefore inferior to Example steels of comparable S content in machinability evaluation index VL1000.

The steels of Comparative Examples Nos. 17, 20, 23, 26 and 29 had high Al or N content. As the value of Al×N of these steels was therefore above the range satisfying Eq. (1), coarse AlN precipitates occurred to make their machinability evaluation index VL1000 inferior to that of Example steels of comparable S content.

The steels of Comparative Examples Nos. 18, 21, 24, 27 and 30 were heat-treated at a low heating temperature of 1,200° C., so that coarse AlN precipitates occurred to make their machinability evaluation index VL1000 inferior to that of Example steels of comparable S content.

Second Set of Examples

In the Second Set of Examples, medium-carbon steels were examined for machinability and impact value after normalization and water quenching-tempering. In this set of Examples, steels of the compositions shown in Table 2-1, 150 kg each, were produced in a vacuum furnace, hot-forged under the heating temperatures shown in Table 2-3 to obtain elongation-forged cylindrical rods of 65-mm diameter. The properties of the Example steels were evaluated by subjecting them to machinability testing, Charpy impact testing, and AlN precipitate observation by the methods set out below.

TABLE 2-1

| | Chemical composition (mass %) | | | | | | | |
|---|---|---|---|---|---|---|---|---|
| | No. | C | Si | Mn | P | S | Al | N |
| Invention Example | 31 | 0.48 | 0.21 | 0.71 | 0.010 | 0.012 | 0.085 | 0.0107 |
| Invention Example | 32 | 0.45 | 0.23 | 0.78 | 0.013 | 0.023 | 0.093 | 0.0088 |
| Invention Example | 33 | 0.48 | 0.23 | 0.78 | 0.010 | 0.058 | 0.125 | 0.0073 |
| Invention Example | 34 | 0.46 | 0.23 | 0.77 | 0.011 | 0.097 | 0.180 | 0.0050 |
| Invention Example | 35 | 0.47 | 0.20 | 0.75 | 0.013 | 0.130 | 0.101 | 0.0091 |

TABLE 2-1-continued

| | Chemical composition (mass %) | | | | | | | |
|---|---|---|---|---|---|---|---|---|
| | No. | C | Si | Mn | P | S | Al | N |
| Invention Example | 36 | 0.46 | 0.23 | 0.75 | 0.012 | 0.120 | 0.102 | 0.0055 |
| Comparative Example | 37 | 0.48 | 0.19 | 0.71 | 0.010 | 0.013 | 0.021 | 0.0138 |
| Comparative Example | 38 | 0.46 | 0.24 | 0.79 | 0.013 | 0.023 | 0.211 | 0.0096 |
| Comparative Example | 39 | 0.46 | 0.24 | 0.70 | 0.012 | 0.044 | 0.121 | 0.0069 |
| Comparative Example | 40 | 0.45 | 0.23 | 0.76 | 0.010 | 0.101 | 0.039 | 0.0099 |
| Comparative Example | 41 | 0.44 | 0.23 | 0.74 | 0.014 | 0.144 | 0.246 | 0.0051 |

Machinability Test

Machinability testing was conducted on the forged steels by subjecting each to heat treatment for normalization consisting of holding under temperature condition of 850° C. for 1 hr followed by air cooling, slicing a 11-mm thick cross-section disk from the heat-treated steel, holding the disk under temperature condition of 850° C. for 1 hr followed by water quenching, and then heat-treating it under temperature condition of 500° C., thereby adjusting its HV10 hardness to within the range of 300 to 310. A machinability evaluation test piece was then cut from each heat-treated steel and the machinabilities of the Example and Comparative Example steels were evaluated by conducting drill boring testing under the cutting conditions shown in Table 2-2.

The maximum cutting speed VL1000 enabling cutting up to a cumulative hole depth of 1000 mm was used as the evaluation index in the drill boring test.

TABLE 2-2

| Cutting conditions | | Drill | | Other |
|---|---|---|---|---|
| Speed | 1-150 m/min | Drill diameter: ϕ3 mm | Hole depth | 9 mm |
| Feed | 0.1 mm/rev | NACHI HSS straight drill | | |
| Cutting fluid | Water-soluble cutting oil | Overhang: 45 mm | Tool life | Until breakage |

Charpy Impact Test

Figure 2:
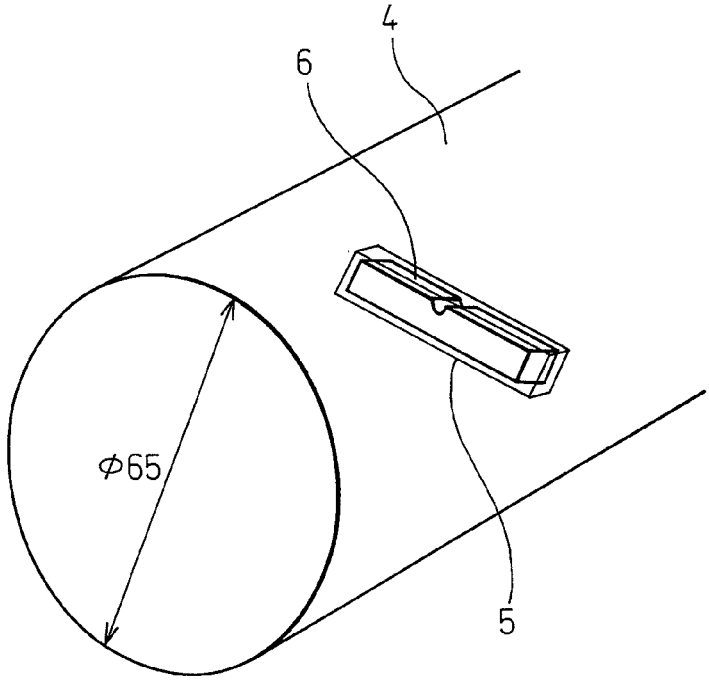
FIG. 2 is a diagram showing the region from which a Charpy impact test piece was cut in Example 2.

FIG. 2 is a diagram showing the region from which the Charpy impact test piece was cut. In the Charpy impact test, first, as shown in FIG. 2, a rectangular-bar-like test piece 5 larger than the Charpy test piece 6 by 1 mm per side was cut from each forged steel 4 so that its axis was perpendicular to the elongation-forging direction of the steel 4 after it had been subjected to heat treatment for normalization consisting of holding under temperature condition of 850° C. for 1 hr followed by air cooling. Next, each bar-like test piece 5 was held under temperature condition of 850° C. for 1 hr, water-quenched with water cooling, held under temperature condition of 550° C. for 30 min, and subjected to tempering with water cooling. Next, the bar-like test piece 5 was machined to fabricate the Charpy test piece 6 in conformance with JIS Z 2202, which was subjected to a Charpy impact test at room temperature in accordance with the method prescribed by JIS Z 2242. Absorbed energy per unit area (J/cm$^2$) was adopted as the evaluation index.

AlN Precipitate Observation

AlN precipitate observation was conducted by the transmission electron microscope replica method using a specimen cut from the Q region of a steel fabricated by the same method as that for the machinability evaluation test piece.

AlN precipitate observation was carried out for 20 randomly selected 1,000 $\mu m^2$ fields to determine the fraction (%) of all AlN precipitates accounted for by AlN precipitates of a circle-equivalent diameter exceeding 200 nm.

The results of the foregoing tests are summarized in Table 2-3.

TABLE 2-3

| | No. | Al × N × 100000 | Heating temp (° C.) | AlN fraction (%) | VL1000 (m/min) | Impact value (J/cm2) |
|---|---|---|---|---|---|---|
| Invention Example | 31 | 91 | 1250 | 17.2 | 35 | 34 |
| Invention Example | 32 | 82 | 1250 | 14.0 | 45 | 29 |
| Invention Example | 33 | 91 | 1250 | 17.3 | 56 | 23 |
| Invention Example | 34 | 90 | 1250 | 16.9 | 60 | 19 |
| Invention Example | 35 | 92 | 1250 | 17.3 | 67 | 17 |
| Invention Example | 36 | 56 | 1250 | 5.8 | 68 | 16 |
| Comparative Example | 37 | 29 | 1200 | 2.9 | 14 | 36 |
| Comparative Example | 38 | 203 | 1250 | 85.5 | 15 | 29 |
| Comparative Example | 39 | 83 | 1200 | 26.5 | 27 | 26 |
| Comparative Example | 40 | 39 | 1250 | 3.1 | 32 | 21 |
| Comparative Example | 41 | 125 | 1250 | 32.8 | 40 | 18 |

In Tables 2-1 and 2-3, the Steels No. 31 to No. 36 are Examples of the present invention and the Steels No. 37 to No. 41 are Comparative Examples.

Figure 5:
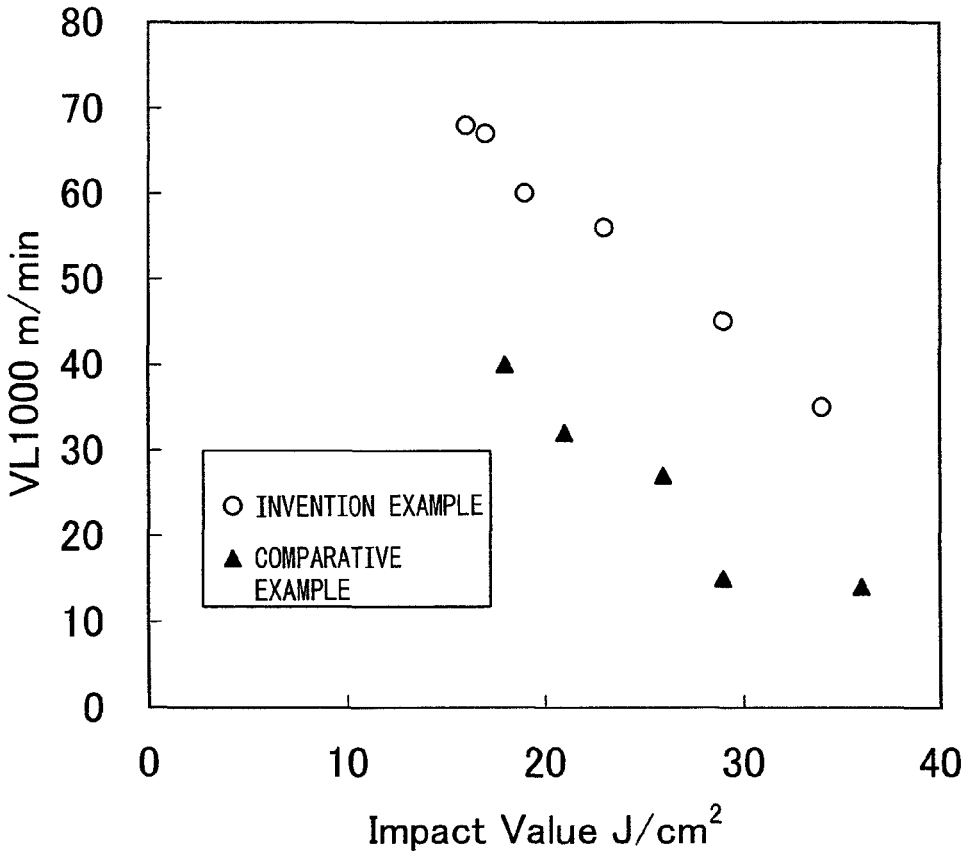
FIG. 5 is a diagram showing the relationship between impact value and machinability in Example 2.

As shown in Table 2-3, the steels of Examples No 31 to No. 36 exhibited well-balanced evaluation indexes, namely VL1000 and impact value (absorbed energy), but the steels of the Comparative Examples 37 to 41 were each inferior to the Example steels in at least one of the properties, so that the balance between VL1000 and impact value (absorbed energy) was poor. (See FIG. 5.)

Specifically, the steels of Comparative Examples Nos. 37 and 40 had Al contents below the range prescribed by the present invention and were therefore inferior to Example steels of comparable S content in machinability evaluation index VL1000.

The steels of Comparative Examples Nos. 38 and 41 had high Al or N content. As the value of Al×N of these steels was therefore above the range satisfying Eq. (1), coarse AlN precipitates occurred to make their machinability evaluation index VL1000 inferior to that of Example steels of comparable S content.

The steel of Comparative Example No. 39 was heat-treated at a low heating temperature of 1,200° C., so that coarse AlN precipitates occurred to make its machinability evaluation index VL1000 inferior to that of Example steels of comparable S content.

Third Set of Examples

In the Third Set of Examples, low-carbon steels were examined for machinability and impact value after normalization. In this set of Examples, steels of the compositions shown in Table 3-1, 150 kg each, were produced in a vacuum furnace, hot-forged or hot-rolled under the heating temperatures shown in Table 3-3 to obtain 65-mm diameter cylindrical rods. The properties of the Example steels were evaluated by subjecting them to machinability testing, Charpy impact testing, and AlN precipitate observation by the methods set out below.

TABLE 3-1

| | Chemical composition (mass %) | | | | | | | |
|---|---|---|---|---|---|---|---|---|
| | No. | C | Si | Mn | P | S | Al | N |
| Invention Example | 42 | 0.09 | 0.22 | 0.46 | 0.013 | 0.012 | 0.110 | 0.0055 |
| Invention Example | 43 | 0.10 | 0.24 | 0.52 | 0.012 | 0.030 | 0.089 | 0.0072 |
| Invention Example | 44 | 0.08 | 0.24 | 0.46 | 0.015 | 0.054 | 0.125 | 0.0068 |
| Invention Example | 45 | 0.09 | 0.23 | 0.47 | 0.010 | 0.133 | 0.114 | 0.0063 |
| Comparative Example | 46 | 0.08 | 0.24 | 0.46 | 0.013 | 0.014 | 0.020 | 0.0052 |
| Comparative Example | 47 | 0.10 | 0.24 | 0.54 | 0.015 | 0.022 | 0.211 | 0.0059 |
| Comparative Example | 48 | 0.10 | 0.22 | 0.47 | 0.013 | 0.054 | 0.131 | 0.0072 |
| Comparative Example | 49 | 0.08 | 0.20 | 0.47 | 0.015 | 0.100 | 0.034 | 0.0034 |
| Comparative Example | 50 | 0.11 | 0.19 | 0.54 | 0.015 | 0.150 | 0.200 | 0.0058 |

Machinability Test

Machinability testing was conducted on the forged steels by subjecting each to heat treatment for normalization consisting of holding under temperature condition of 920° C. for 1 hr followed by air cooling, thereby adjusting its HV10 hardness to within the range of 115 to 120. A machinability evaluation test piece was then cut from each heat-treated steel and the machinabilities of the Example and Comparative Example steels were evaluated by conducting drill boring testing under the cutting conditions shown in Table 3-2.

The maximum cutting speed VL1000 enabling cutting up to a cumulative hole depth of 1000 mm was used as the evaluation index in the drill boring test.

TABLE 3-2

| Cutting conditions | | Drill | Other | |
|---|---|---|---|---|
| Speed | 1-150 m/min | Drill diameter: ϕ3 mm | Hole depth | 9 mm |
| Feed | 0.25 mm/rev | NACHI HSS straight drill | | |
| Cutting fluid | Water-soluble cutting oil | Overhang: 45 mm | Tool life | Until breakage |

Charpy Impact Test

Figure 3:
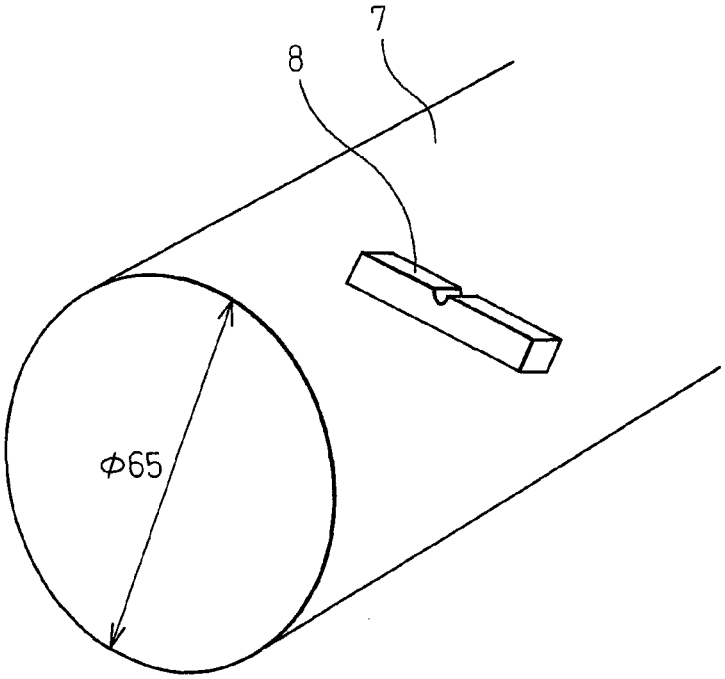
FIG. 3 is a diagram showing the region from which Charpy impact test pieces were cut in Examples 3 to 7.

FIG. 3 is a diagram showing the region from which the Charpy impact test piece was cut. In the Charpy impact test, first, as shown in FIG. 3, a Charpy test piece 8 in conformance with JIS Z 2202 was fabricated by machining from each steel 7, which had been heat-treated by the same method and under the same conditions as in the aforesaid machinability test, so that its axis was perpendicular to the elongation-forging direction of the steel 7. The test piece 8 was subjected to a Charpy impact test at room temperature in accordance with the method prescribed by JIS Z 2242. Absorbed energy per unit area ($J/cm^2$) was adopted as the evaluation index.

AlN Precipitate Observation

AlN precipitate observation was conducted by the transmission electron microscope replica method using a specimen cut from the Q region of a steel fabricated by the same method as that for the machinability evaluation test piece.

AlN precipitate observation was carried out for 20 randomly selected 1,000 $\mu m^2$ fields to determine the fraction (%)

of all AlN precipitates accounted for by AlN precipitates of a circle-equivalent diameter exceeding 200 nm.

The results of the foregoing tests are summarized in Table 3-3.

TABLE 3-3

| | No. | Al × N × 100000 | Heating temp (° C.) | AlN fraction (%) | VL1000 (m/min) | Impact value (J/cm2) |
|---|---|---|---|---|---|---|
| Invention Example | 42 | 61 | 1250 | 7.6 | 83 | 66 |
| Invention Example | 43 | 64 | 1250 | 8.6 | 98 | 62 |
| Invention Example | 44 | 85 | 1250 | 14.7 | 113 | 56 |
| Invention Example | 45 | 72 | 1250 | 10.7 | 140 | 52 |
| Comparative Example | 46 | 10 | 1250 | 0.2 | 48 | 68 |
| Comparative Example | 47 | 124 | 1250 | 32.3 | 50 | 65 |
| Comparative Example | 48 | 94 | 1150 | 32.1 | 57 | 57 |
| Comparative Example | 49 | 12 | 1250 | 0.3 | 66 | 54 |
| Comparative Example | 50 | 116 | 1250 | 28.0 | 71 | 51 |

In Tables 3-1 and 3-3, the Steels No. 42 to No. 45 are Examples of the present invention and the Steels No. 46 to No. 50 are Comparative Examples.

Figure 6:
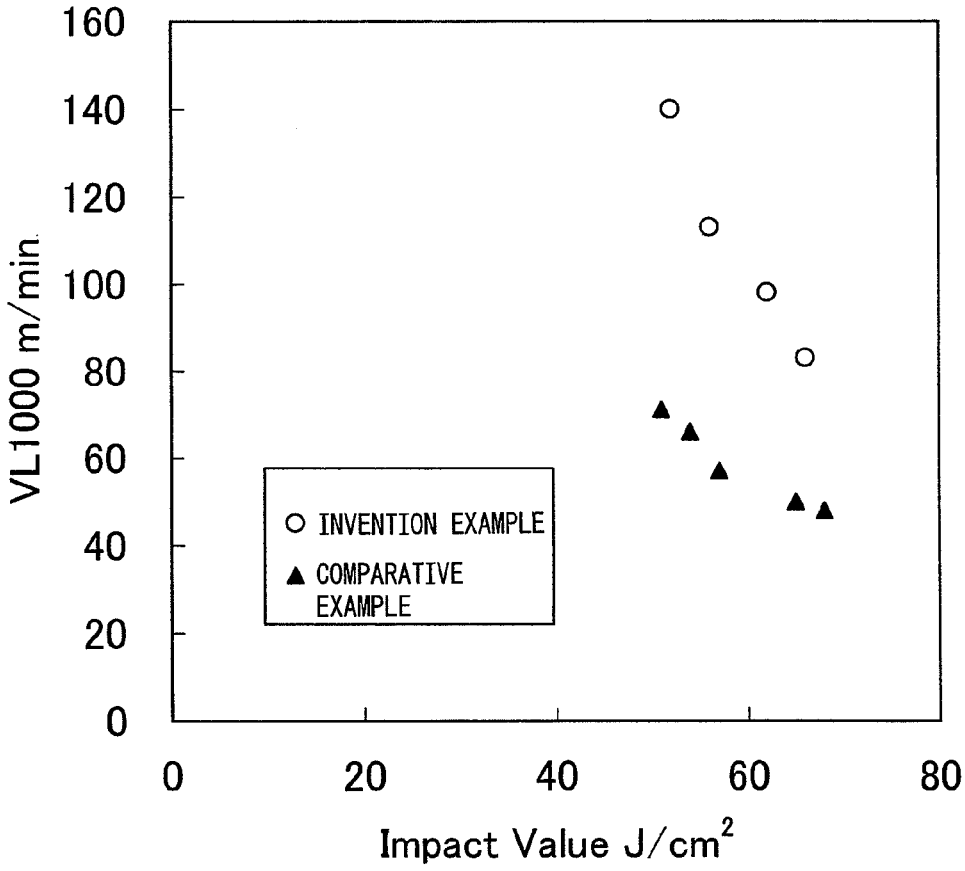
FIG. 6 is a diagram showing the relationship between impact value and machinability in Example 3.

As shown in Table 3-3, the steels of Examples No 42 to No. 45 exhibited well-balanced evaluation indexes, namely VL1000 and impact value (absorbed energy), but the steels of the Comparative Examples 46 to 50 were each inferior to the Example steels in at least one of the properties, so that the balance between VL1000 and impact value (absorbed energy) was poor. (See FIG. 6.)

Specifically, the steels of Comparative Examples Nos. 46 and 49 had Al contents below the range prescribed by the present invention and were therefore inferior to Example steels of comparable S content in machinability evaluation index VL1000.

The steels of Comparative Examples Nos. 47 and 50 had high Al or N content. As the value of Al×N of these steels was therefore above the range satisfying Eq. (1), coarse AlN precipitates occurred to make their machinability evaluation index VL1000 inferior to that of Example steels of comparable S content.

The steel of Comparative Example Nos. 48 was heat-treated at a low heating temperature of 1,150° C., so that coarse AlN precipitates occurred to make its machinability evaluation index VL1000 inferior to that of Example steels of comparable S content.

Fourth Set of Examples

In the Fourth Set of Examples, medium-carbon steels were examined for machinability and impact value after hot-forging followed by air cooling (untempered). In this set of Examples, steels of the compositions shown in Table 4-1, 150 kg each, were produced in a vacuum furnace, hot-forged under the heating temperatures shown in Table 4-3 to elongation-forge them into 65-mm diameter cylindrical rods and air cooled, thereby adjusting their HV10 hardness to within the range of 210 to 230. The properties of the Example steels were evaluated by subjecting them to machinability testing, Charpy impact testing, and AlN precipitate observation by the methods set out below.

TABLE 4-1

| | Chemical composition (mass %) | | | | | | | |
|---|---|---|---|---|---|---|---|---|
| | No. | C | Si | Mn | P | S | Al | N |
| Invention Example | 51 | 0.39 | 0.59 | 1.44 | 0.012 | 0.015 | 0.109 | 0.0055 |
| Invention Example | 52 | 0.38 | 0.55 | 1.45 | 0.014 | 0.020 | 0.098 | 0.0072 |
| Invention Example | 53 | 0.37 | 0.56 | 1.53 | 0.010 | 0.048 | 0.119 | 0.0068 |
| Invention Example | 54 | 0.36 | 0.18 | 1.80 | 0.011 | 0.095 | 0.102 | 0.0049 |
| Invention Example | 55 | 0.39 | 0.59 | 1.46 | 0.010 | 0.140 | 0.111 | 0.0063 |
| Comparative Example | 56 | 0.39 | 0.59 | 1.40 | 0.015 | 0.010 | 0.023 | 0.0052 |
| Comparative Example | 57 | 0.38 | 0.59 | 1.50 | 0.010 | 0.021 | 0.209 | 0.0059 |
| Comparative Example | 58 | 0.39 | 0.54 | 1.40 | 0.014 | 0.040 | 0.135 | 0.0072 |
| Comparative Example | 59 | 0.39 | 0.53 | 1.54 | 0.015 | 0.102 | 0.039 | 0.0034 |
| Comparative Example | 60 | 0.39 | 0.57 | 1.43 | 0.011 | 0.132 | 0.320 | 0.0058 |

Machinability Test

In machinability testing, machinability evaluation test pieces were cut from the elongation-forged steels of the respective examples and the machinabilities of the Example and Comparative Examples steels were evaluated by drill boring testing conducted under the cutting conditions shown in Table 4-2.

The maximum cutting speed VL1000 enabling cutting up to a cumulative hole depth of 1000 mm was used as the evaluation index in the drill boring test.

TABLE 4-2

| Cutting conditions | | Drill | Other | |
|---|---|---|---|---|
| Speed | 1-150 m/min | Drill diameter: ϕ3 mm | Hole depth | 9 mm |
| Feed | 0.25 mm/rev | NACHI HSS straight drill | | |
| Cutting fluid | Water-soluble cutting oil | Overhang: 45 mm | Tool life | Until breakage |

Charpy Impact Test

FIG. 3 is a diagram showing the region from which the Charpy impact test piece was cut. In the Charpy impact test, first, as shown in FIG. 3, a Charpy test piece 8 in conformance with JIS Z 2202 was fabricated by machining from each forged steel 7 so that its axis was perpendicular to the elongation-forging direction of the steel 7. The test piece 8 was subjected to a Charpy impact test at room temperature in accordance with the method prescribed by JIS Z 2242. Absorbed energy per unit area (J/cm$^2$) was adopted as the evaluation index.

AlN Precipitate Observation

AlN precipitate observation was conducted by the transmission electron microscope replica method using a specimen cut from the Q region of a steel fabricated by the same method as that for the machinability evaluation test piece.

AlN precipitate observation was carried out for 20 randomly selected 1,000 μm$^2$ fields to determine the fraction (%) of all AlN precipitates accounted for by AlN precipitates of a circle-equivalent diameter exceeding 200 nm.

The results of the foregoing tests are summarized in Table 4-3.

TABLE 4-3

| | No. | Al × N × 100000 | Heating temp (° C.) | AlN fraction (%) | VL1000 (m/min) | Impact value (J/cm2) |
|---|---|---|---|---|---|---|
| Invention Example | 51 | 60 | 1250 | 7.5 | 40 | 15 |
| Invention Example | 52 | 71 | 1250 | 9.7 | 52 | 14 |
| Invention Example | 53 | 81 | 1250 | 13.6 | 61 | 10 |
| Invention Example | 54 | 50 | 1250 | 5.0 | 72 | 8 |
| Invention Example | 55 | 70 | 1250 | 9.8 | 77 | 6 |
| Comparative Example | 56 | 12 | 1250 | 0.3 | 25 | 17 |
| Comparative Example | 57 | 123 | 1250 | 31.7 | 36 | 12 |
| Comparative Example | 58 | 97 | 1200 | 30.1 | 40 | 11 |
| Comparative Example | 59 | 13 | 1250 | 0.4 | 47 | 8 |
| Comparative Example | 60 | 186 | 1250 | 71.8 | 55 | 6 |

In Tables 4-1 and 4-3, the Steels No. 51 to No. 55 are Examples of the present invention and the Steels No. 56 to No. 60 are Comparative Examples.

Figure 7:
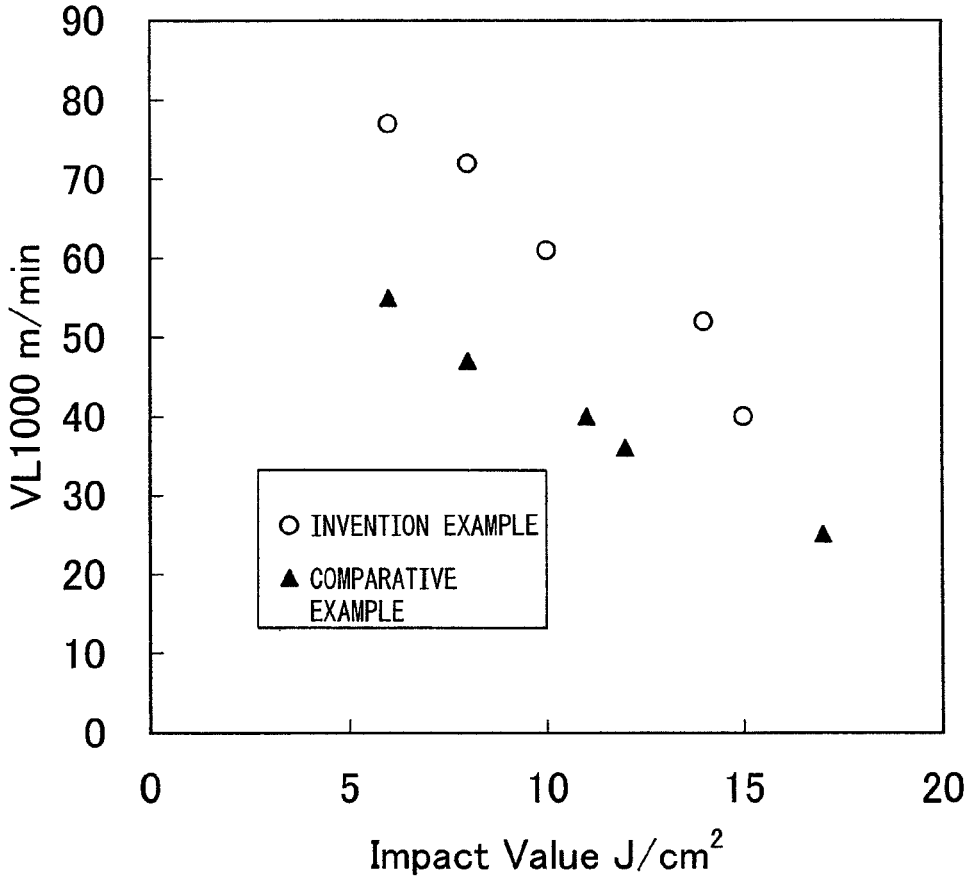
FIG. 7 is a diagram showing the relationship between impact value and machinability in Example 4.

As shown in Table 4-3, the steels of Examples No 51 to No. 55 exhibited well-balanced evaluation indexes, namely VL1000 and impact value (absorbed energy), but the steels of the Comparative Examples 56 to 60 were each inferior to the Example steels in at least one of the properties, so that the balance between VL1000 and impact value (absorbed energy) was poor. (See FIG. 7.)

Specifically, the steels of Comparative Examples Nos. 56 and 59 had Al contents below the range prescribed by the present invention and were therefore inferior to Example steels of comparable S content in machinability evaluation index VL1000.

The steels of Comparative Examples Nos. 57 and 60 had high Al or N content. As the value of Al×N of these steels was therefore above the range satisfying Eq. (1), coarse AlN precipitates occurred to make their machinability evaluation index VL1000 inferior to that of Example steels of comparable S content.

The steel of Comparative Example Nos. 58 had high Al or N content. As the value of Al×N of this steel was therefore above the range satisfying Eq. (1). In addition, it was heat-treated at a low heating temperature of 1,200° C. As a result, coarse AlN precipitates occurred to make their machinability evaluation index VL1000 inferior to that of Example steels of comparable S content.

Fifth Set of Examples

In the Fifth Set of Examples, low-carbon alloy steels containing Cr and V as alloying elements were examined for machinability and impact value after hot-forging followed by air cooling (untempered). In this set of Examples, steels of the compositions shown in Table 5-1, 150 kg each, were produced in a vacuum furnace, hot-forged under the heating temperatures shown in Table 5-3 to elongation-forge them into 65-mm diameter cylindrical rods and air cooled, thereby adjusting their HV10 hardness to within the range of 200 to 220. The properties of the Example steels were evaluated by subjecting them to machinability testing, Charpy impact testing, and AlN precipitate observation by the methods set out below.

TABLE 5-1

| | Chemical composition (mass %) | | | | | | | | | |
|---|---|---|---|---|---|---|---|---|---|---|
| | No. | C | Si | Mn | P | S | Al | N | V | Cr |
| Invention Example | 61 | 0.23 | 0.30 | 0.88 | 0.026 | 0.014 | 0.091 | 0.0101 | 0.23 | 0.13 |
| Invention Example | 62 | 0.23 | 0.30 | 0.90 | 0.025 | 0.015 | 0.101 | 0.0053 | 0.23 | 0.13 |
| Invention Example | 63 | 0.23 | 0.29 | 0.90 | 0.026 | 0.025 | 0.098 | 0.0085 | 0.25 | 0.15 |
| Invention Example | 64 | 0.23 | 0.30 | 0.91 | 0.026 | 0.040 | 0.119 | 0.0078 | 0.23 | 0.15 |
| Invention Example | 65 | 0.23 | 0.28 | 0.92 | 0.024 | 0.099 | 0.180 | 0.0052 | 0.25 | 0.13 |
| Invention Example | 66 | 0.20 | 0.32 | 0.92 | 0.024 | 0.150 | 0.101 | 0.0093 | 0.25 | 0.17 |
| Comparative Example | 67 | 0.22 | 0.28 | 0.92 | 0.025 | 0.011 | 0.023 | 0.0102 | 0.25 | 0.15 |
| Comparative Example | 68 | 0.22 | 0.32 | 0.90 | 0.024 | 0.024 | 0.209 | 0.0098 | 0.24 | 0.16 |
| Comparative Example | 69 | 0.21 | 0.31 | 0.91 | 0.025 | 0.044 | 0.130 | 0.0073 | 0.25 | 0.13 |
| Comparative Example | 70 | 0.20 | 0.31 | 0.89 | 0.027 | 0.095 | 0.033 | 0.0085 | 0.23 | 0.16 |
| Comparative Example | 71 | 0.23 | 0.31 | 0.90 | 0.023 | 0.140 | 0.320 | 0.0099 | 0.24 | 0.15 |

Machinability Test

In machinability testing, machinability evaluation test pieces were cut from the elongation-forged steels of the respective examples and the machinabilities of the Example and Comparative Examples steels were evaluated by drill boring testing conducted under the cutting conditions shown in Table 5-2.

The maximum cutting speed VL1000 enabling cutting up to a cumulative hole depth of 1000 mm was used as the evaluation index in the drill boring test.

TABLE 5-2

| Cutting conditions | | Drill | | Other |
|---|---|---|---|---|
| Speed | 1-150 m/min | Drill diameter: ϕ3 mm | Hole depth | 9 mm |
| Feed | 0.25 mm/rev | NACHI HSS straight drill | | |
| Cutting fluid | Water-soluble cutting oil | Overhang: 45 mm | Tool life | Until breakage |

Charpy Impact Test

FIG. 3 is a diagram showing the region from which the Charpy impact test piece was cut. In the Charpy impact test, first, as shown in FIG. 3, a Charpy test piece 8 in conformance with JIS Z 2202 was fabricated by machining from each forged steel 7 so that its axis was perpendicular to the elongation-forging direction of the steel 7. The test piece 8 was subjected to a Charpy impact test at room temperature in accordance with the method prescribed by JIS Z 2242. Absorbed energy per unit area ($J/Cm^2$) was adopted as the evaluation index.

AlN Precipitate Observation

AlN precipitate observation was conducted by the transmission electron microscope replica method using a specimen cut from the Q region of a steel fabricated by the same method as that for the machinability evaluation test piece.

AlN precipitate observation was carried out for 20 randomly selected 1,000 $\mu m^2$ fields to determine the fraction (%) of all AlN precipitates accounted for by AlN precipitates of a circle-equivalent diameter exceeding 200 nm.

The results of the foregoing tests are summarized in Table 5-3.

TABLE 5-3

| | No. | Al × N × 100000 | Heating temp (° C.) | AlN fraction (%) | VL1000 (m/min) | Impact value (J/cm2) |
|---|---|---|---|---|---|---|
| Invention Example | 61 | 92 | 1250 | 17.6 | 40 | 15 |
| Invention Example | 62 | 54 | 1250 | 6.0 | 42 | 16 |
| Invention Example | 63 | 83 | 1250 | 14.5 | 51 | 12 |
| Invention Example | 64 | 93 | 1250 | 17.9 | 61 | 10 |
| Invention Example | 65 | 94 | 1250 | 18.3 | 73 | 9 |
| Invention Example | 66 | 94 | 1250 | 18.4 | 75 | 5 |
| Comparative Example | 67 | 23 | 1250 | 1.1 | 25 | 16 |
| Comparative Example | 68 | 205 | 1250 | 87.4 | 34 | 12 |
| Comparative Example | 69 | 95 | 1200 | 29.5 | 42 | 11 |
| Comparative Example | 70 | 28 | 1250 | 1.6 | 49 | 9 |
| Comparative Example | 71 | 317 | 1250 | 98.0 | 55 | 5 |

In Tables 5-1 and 5-3, the Steels No. 61 to No. 66 are Examples of the present invention and the Steels No. 67 to No. 71 are Comparative Examples.

Figure 8:
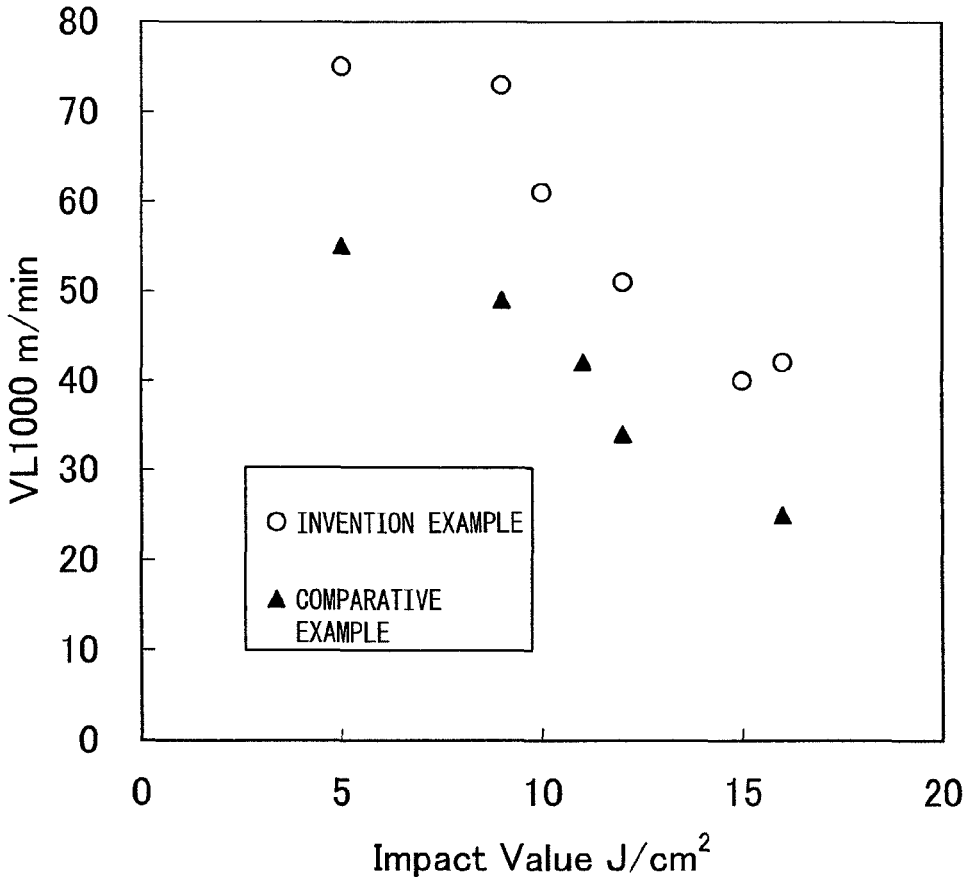
FIG. 8 is a diagram showing the relationship between impact value and machinability in Example 5.

As shown in Table 5-3, the steels of Examples No 61 to No. 66 exhibited well-balanced evaluation indexes, namely VL1000 and impact value (absorbed energy), but the steels of the Comparative Examples 67 to 71 were each inferior to the Example steels in at least one of the properties, so that the balance between VL1000 and impact value (absorbed energy) was poor. (See FIG. 8.)

Specifically, the steels of Comparative Examples Nos. 67 and 70 had Al contents below the range prescribed by the present invention and were therefore inferior to Example steels of comparable S content in machinability evaluation index VL1000.

The steels of Comparative Examples Nos. 68 and 71 had high Al or N content. As the value of Al×N of these steels was therefore above the range satisfying Eq. (1), coarse AlN precipitates occurred to make their machinability evaluation index VL1000 inferior to that of Example steels of comparable S content.

The steel of Comparative Example No. 69 was heat-treated at a low heating temperature of 1,200° C., so that coarse AlN precipitates occurred to make its machinability evaluation index VL1000 inferior to that of Example steels of comparable S content.

Sixth Set of Examples

In the Sixth Set of Examples, medium-carbon alloy steels containing Cr and V as alloying elements and having a high Si content were examined for machinability and impact value after hot-forging followed by air cooling (untempered). In this set of Examples, steels of the compositions shown in Table 6-1, 150 kg each, were produced in a vacuum furnace, hot-forged under the heating temperatures shown in Table 6-3 to elongation-forge them into 65-mm diameter cylindrical rods and air cooled, thereby adjusting their HV10 hardness to within the range of 280 to 300. The properties of the example steels were evaluated by subjecting them to machinability testing, Charpy impact testing, and AlN precipitate observation by the methods set out below.

TABLE 6-1

| | Chemical composition (mass %) | | | | | | | | | |
|---|---|---|---|---|---|---|---|---|---|---|
| | No. | C | Si | Mn | P | S | Al | N | V | Cr |
| Invention Example | 72 | 0.30 | 1.31 | 1.48 | 0.024 | 0.010 | 0.084 | 0.0105 | 0.09 | 0.35 |
| Invention Example | 73 | 0.30 | 1.30 | 1.48 | 0.025 | 0.010 | 0.099 | 0.0055 | 0.09 | 0.35 |
| Invention Example | 74 | 0.29 | 1.31 | 1.48 | 0.027 | 0.024 | 0.097 | 0.0089 | 0.10 | 0.34 |
| Invention Example | 75 | 0.31 | 1.29 | 1.48 | 0.023 | 0.044 | 0.121 | 0.0076 | 0.10 | 0.34 |

TABLE 6-1-continued

| | Chemical composition (mass %) | | | | | | | | | |
|---|---|---|---|---|---|---|---|---|---|---|
| | No. | C | Si | Mn | P | S | Al | N | V | Cr |
| Invention Example | 76 | 0.30 | 1.31 | 1.48 | 0.025 | 0.096 | 0.182 | 0.0049 | 0.10 | 0.35 |
| Invention Example | 77 | 0.31 | 1.29 | 1.48 | 0.023 | 0.146 | 0.102 | 0.0090 | 0.11 | 0.35 |
| Comparative Example | 78 | 0.30 | 1.31 | 1.52 | 0.026 | 0.014 | 0.023 | 0.0134 | 0.09 | 0.34 |
| Comparative Example | 79 | 0.31 | 1.28 | 1.48 | 0.026 | 0.022 | 0.209 | 0.0099 | 0.10 | 0.35 |
| Comparative Example | 80 | 0.30 | 1.31 | 1.51 | 0.027 | 0.047 | 0.132 | 0.0065 | 0.11 | 0.36 |
| Comparative Example | 81 | 0.30 | 1.32 | 1.51 | 0.026 | 0.100 | 0.035 | 0.0089 | 0.10 | 0.36 |
| Comparative Example | 82 | 0.29 | 1.30 | 1.49 | 0.025 | 0.147 | 0.220 | 0.0093 | 0.11 | 0.34 |

Machinability Test

In machinability testing, machinability evaluation test pieces were cut from the elongation-forged steels of the respective examples and the machinabilities of the Example and Comparative Examples steels were evaluated by drill boring testing conducted under the cutting conditions shown in Table 6-2.

The maximum cutting speed VL1000 enabling cutting up to a cumulative hole depth of 1000 mm was used as the evaluation index in the drill boring test.

TABLE 6-2

| Cutting conditions | | Drill | | Other |
|---|---|---|---|---|
| Speed | 1-150 m/min | Drill diameter: ϕ3 mm | Hole depth | 9 mm |
| Feed | 0.25 mm/rev | NACHI HSS straight drill | | |
| Cutting fluid | Water-soluble cutting oil | Overhang: 45 mm | Tool life | Until breakage |

Charpy Impact Test

FIG. 3 is a diagram showing the region from which the Charpy impact test piece was cut. In the Charpy impact test, first, as shown in FIG. 3, a Charpy test piece 8 in conformance with JIS Z 2202 was fabricated by machining from each forged steel 7 so that its axis was perpendicular to the elongation-forging direction of the steel 7. The test piece 8 was subjected to a Charpy impact test at room temperature in accordance with the method prescribed by JIS Z 2242. Absorbed energy per unit area (J/cm$^2$) was adopted as the evaluation index.

AlN Precipitate Observation

AlN precipitate observation was conducted by the transmission electron microscope replica method using a specimen cut from the Q region of a steel fabricated by the same method as that for the machinability evaluation test piece.

AlN precipitate observation was carried out for 20 randomly selected 1,000 μm$^2$ fields to determine the fraction (%) of all AlN precipitates accounted for by AlN precipitates of a circle-equivalent diameter exceeding 200 nm.

The results of the foregoing tests are summarized in Table 6-3.

TABLE 6-3

| | No. | Al × N × 100000 | Heating temp (° C.) | AlN fraction (%) | VL1000 (m/min) | Impact value (J/cm2) |
|---|---|---|---|---|---|---|
| Invention Example | 72 | 88 | 1250 | 16.2 | 10 | 14 |
| Invention Example | 73 | 54 | 1250 | 6.2 | 12 | 15 |
| Invention Example | 74 | 86 | 1250 | 14.8 | 15 | 12 |
| Invention Example | 75 | 92 | 1250 | 17.6 | 32 | 9 |
| Invention Example | 76 | 89 | 1250 | 16.6 | 47 | 7 |
| Invention Example | 77 | 92 | 1250 | 17.6 | 59 | 4 |
| Comparative Example | 78 | 31 | 1250 | 2.0 | 3 | 13 |
| Comparative Example | 79 | 207 | 1250 | 89.2 | 5 | 10 |
| Comparative Example | 80 | 86 | 1200 | 22.7 | 15 | 8 |
| Comparative Example | 81 | 31 | 1250 | 2.0 | 17 | 8 |
| Comparative Example | 82 | 205 | 1250 | 87.2 | 28 | 6 |

In Tables 6-1 and 6-3, the Steels No. 72 to No. 77 are Examples of the present invention and the Steels No. 78 to No. 82 are Comparative Examples.

Figure 9:
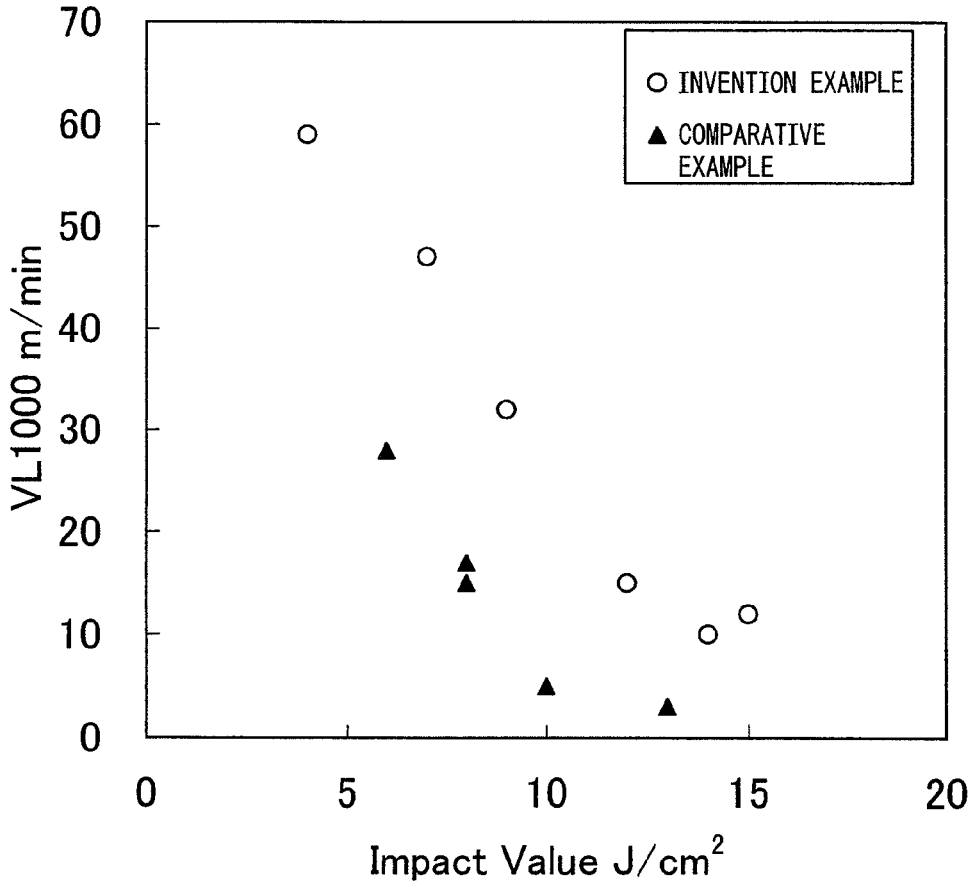
FIG. 9 is a diagram showing the relationship between impact value and machinability in Example 6.

As shown in Table 6-3, the steels of Examples No 72 to No. 77 exhibited well-balanced evaluation indexes, namely VL1000 and impact value (absorbed energy), but the steels of the Comparative Examples 78 to 82 were each inferior to the Example steels in at least one of the properties, so that the balance between VL1000 and impact value (absorbed energy) was poor. (See FIG. 9.)

Specifically, the steels of Comparative Examples Nos. 78 and 81 had Al contents below the range prescribed by the present invention and were therefore inferior to Example steels of comparable S content in machinability evaluation index VL1000.

The steels of Comparative Examples Nos. 79 and 82 had high Al or N content. As the value of Al×N of these steels was therefore above the range satisfying Eq. (1), coarse AlN precipitates occurred to make their machinability evaluation index VL1000 inferior to that of Example steels of comparable S content.

The steel of Comparative Example No. 80 was heat-treated at a low heating temperature of 1,200° C., so that coarse AlN precipitates occurred to make its machinability evaluation index VL1000 inferior to that of Example steels of comparable S content.

Seventh Set of Examples

In the Seventh Set of Examples, medium-carbon alloy steels containing Cr and V as alloying elements and having a low Si content were examined for machinability and impact value after hot-forging followed by air cooling (untempered). In this set of Examples, steels of the compositions shown in Table 7-1, 150 kg each, were produced in a vacuum furnace, hot-forged under the heating temperatures shown in Table 7-3 to elongation-forge them into 65-mm diameter cylindrical rods and air cooled, thereby adjusting their HV10 hardness to within the range of 240 to 260. The properties of the example steels were evaluated by subjecting them to machinability testing, Charpy impact testing, and AlN precipitate observation by the methods set out below.

TABLE 7-1

| | | Chemical composition (mass %) | | | | | | | | |
|---|---|---|---|---|---|---|---|---|---|---|
| | No. | C | Si | Mn | P | S | Al | N | V | Cr |
| Invention Example | 83 | 0.47 | 0.27 | 0.98 | 0.015 | 0.013 | 0.083 | 0.0107 | 0.11 | 0.10 |
| Invention Example | 84 | 0.47 | 0.29 | 0.96 | 0.013 | 0.021 | 0.091 | 0.0088 | 0.11 | 0.12 |
| Invention Example | 85 | 0.45 | 0.30 | 0.98 | 0.015 | 0.050 | 0.123 | 0.0073 | 0.11 | 0.10 |
| Invention Example | 86 | 0.48 | 0.28 | 0.99 | 0.010 | 0.097 | 0.160 | 0.0050 | 0.11 | 0.11 |
| Invention Example | 87 | 0.46 | 0.26 | 0.99 | 0.015 | 0.145 | 0.098 | 0.0091 | 0.11 | 0.10 |
| Invention Example | 88 | 0.46 | 0.26 | 0.97 | 0.014 | 0.021 | 0.097 | 0.0038 | 0.12 | 0.12 |
| Invention Example | 89 | 0.45 | 0.25 | 0.98 | 0.015 | 0.024 | 0.103 | 0.0047 | 0.10 | 0.13 |
| Comparative Example | 90 | 0.47 | 0.26 | 0.97 | 0.012 | 0.010 | 0.019 | 0.0138 | 0.13 | 0.10 |
| Comparative Example | 91 | 0.48 | 0.27 | 0.96 | 0.014 | 0.027 | 0.215 | 0.0096 | 0.10 | 0.12 |
| Comparative Example | 92 | 0.45 | 0.30 | 0.97 | 0.011 | 0.049 | 0.126 | 0.0069 | 0.12 | 0.11 |
| Comparative Example | 93 | 0.47 | 0.26 | 0.98 | 0.013 | 0.090 | 0.029 | 0.0099 | 0.13 | 0.13 |
| Comparative Example | 94 | 0.47 | 0.26 | 0.98 | 0.013 | 0.143 | 0.242 | 0.0051 | 0.11 | 0.13 |

Machinability Test

In machinability testing, machinability evaluation test pieces were cut from the elongation-forged steels of the respective examples and the machinabilities of the Example and Comparative Examples steels were evaluated by drill boring testing conducted under the cutting conditions shown in Table 7-2.

The maximum cutting speed VL1000 enabling cutting up to a cumulative hole depth of 1000 mm was used as the evaluation index in the drill boring test.

TABLE 7-2

| Cutting conditions | | Drill | | Other |
|---|---|---|---|---|
| Speed | 1-150 m/min | Drill diameter: ϕ3 mm | Hole depth | 9 mm |
| Feed | 0.25 mm/rev | NACHI HSS straight drill | | |
| Cutting fluid | Water-soluble cutting oil | Overhang: 45 mm | Tool life | Until breakage |

Charpy Impact Test

FIG. 3 is a diagram showing the region from which the Charpy impact test piece was cut. In the Charpy impact test, first, as shown in FIG. 3, a Charpy test piece 8 in conformance with JIS Z 2202 was fabricated by machining from each forged steel 7 so that its axis was perpendicular to the elongation-forging direction of the steel 7. The test piece 8 was subjected to a Charpy impact test at room temperature in accordance with the method prescribed by JIS Z 2242. Absorbed energy per unit area (J/cm$^2$) was adopted as the evaluation index.

AlN Precipitate Observation

AlN precipitate observation was conducted by the transmission electron microscope replica method using a specimen cut from the Q region of a steel fabricated by the same method as that for the machinability evaluation test piece.

AlN precipitate observation was carried out for 20 randomly selected 1,000 μm$^2$ fields to determine the fraction (%) of all AlN precipitates accounted for by AlN precipitates of a circle-equivalent diameter exceeding 200 nm.

The results of the foregoing tests are summarized in Table 7-3.

TABLE 7-3

| | No. | Al × N × 100000 | Heating temp (° C.) | AlN fraction (%) | VL1000 (m/min) | Impact value (J/cm2) |
|---|---|---|---|---|---|---|
| Invention Example | 83 | 89 | 1250 | 16.4 | 25 | 17 |
| Invention Example | 84 | 80 | 1250 | 13.4 | 36 | 12 |
| Invention Example | 85 | 90 | 1250 | 16.8 | 54 | 10 |
| Invention Example | 86 | 80 | 1250 | 13.3 | 65 | 8 |
| Invention Example | 87 | 89 | 1250 | 16.6 | 66 | 7 |
| Invention Example | 88 | 37 | 1210 | 3.6 | 37 | 13 |

TABLE 7-3-continued

| | No. | Al × N × 100000 | Heating temp (° C.) | AlN fraction (%) | VL1000 (m/min) | Impact value (J/cm2) |
|---|---|---|---|---|---|---|
| Invention Example | 89 | 48 | 1230 | 5.3 | 48 | 11 |
| Comparative Example | 90 | 26 | 1200 | 2.4 | 13 | 17 |
| Comparative Example | 91 | 206 | 1250 | 88.8 | 20 | 14 |
| Comparative Example | 92 | 87 | 1200 | 24.5 | 35 | 11 |
| Comparative Example | 93 | 29 | 1250 | 1.7 | 50 | 9 |
| Comparative Example | 94 | 123 | 1250 | 31.7 | 54 | 5 |

In Tables 7-1 and 7-3, the Steels No. 83 to No. 89 are Examples of the present invention and the Steels No. 90 to No. 94 are Comparative Examples.

Figure 10:
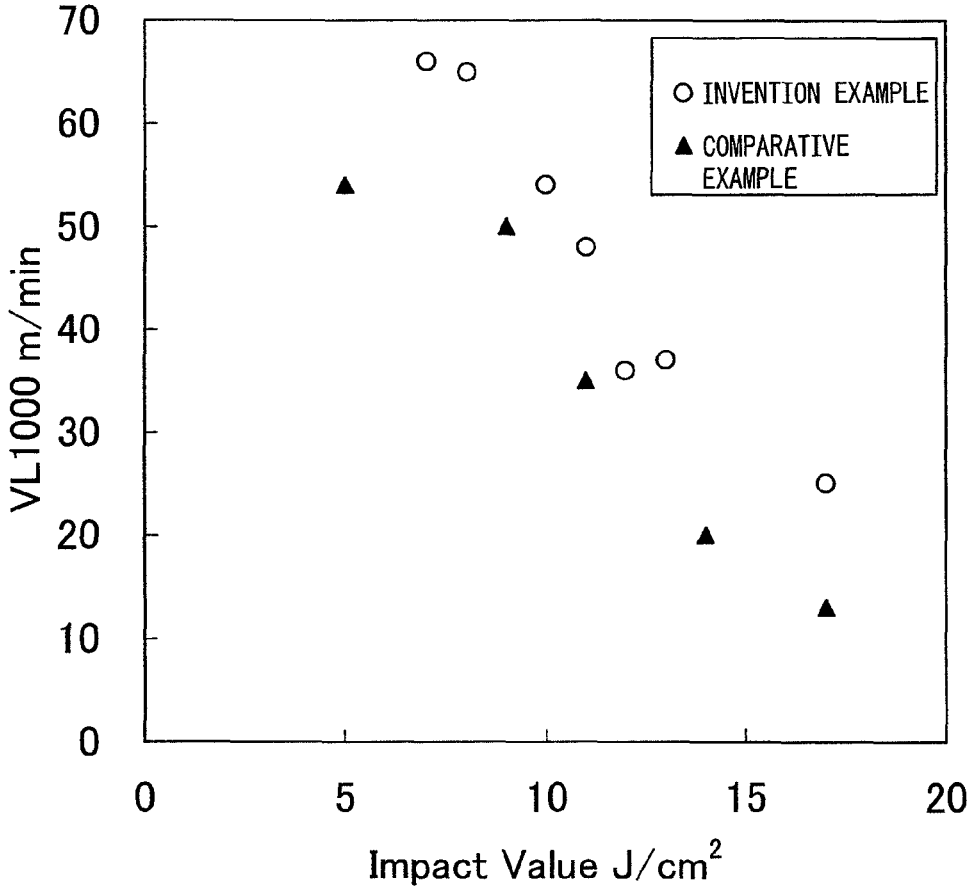
FIG. 10 is a diagram showing the relationship between impact value and machinability in Example 7.

As shown in Table 7-3, the steels of Examples No 83 to No. 89 exhibited well-balanced evaluation indexes, namely VL1000 and impact value (absorbed energy), but the steels of the Comparative Examples 90 to 94 were each inferior to the Example steels in at least one of the properties, so that the balance between VL1000 and impact value (absorbed energy) was poor. (See FIG. 10.)

Specifically, the steels of Comparative Examples Nos. 90 and 93 had Al contents below the range prescribed by the present invention and were therefore inferior to Example steels of comparable S content in machinability evaluation index VL1000.

The steels of Comparative Examples Nos. 91 and 94 had high Al or N content. As the value of Al×N of these steels was therefore above the range satisfying Eq. (1), coarse AlN precipitates occurred to make their machinability evaluation index VL1000 inferior to that of Example steels of comparable S content.

The steel of Comparative Example No. 92 was heat-treated at a low heating temperature of 1,200° C., so that coarse AlN precipitates occurred to make its machinability evaluation index VL1000 inferior to that of Example steels of comparable S content.

INDUSTRIAL APPLICABILITY

The present invention provides a hot-working steel excellent in machinability and impact value that is optimum for machining and application as a machine structural element.

What is claimed is:

1. A hot-worked steel comprising a composition consisting of, in mass %,

C: 0.23 to 0.85%,
Si: 0.01 to 1.5%,
Mn: 0.05 to 2.0%,
P: 0.005 to 0.2%,
S: 0.020 to 0.15%,
Al: 0.110 to 1.0%,
N: 0.016% or less,
and optionally one or more elements in the following ranges:
Ca: 0.0003 to 0.0015%,
Ti: 0.001 to 0.01%,
Nb: 0.005 to 0.2%,
W: 0.01 to 1.0%,
V: 0.01 to 1.0%,
Cr: 0.01 to 2.0%,
Mo: 0.01 to 1.0%,
Ni: 0.05 to 2.0%,
Cu: 0.01 to 2.0%,
Mg: 0.0001 to 0.0040%,
Zr: 0.0003 to 0.01%,
REMs: 0.0001 to 0.015%,
Sn: 0.005 to 2.0%,
Zn: 0.0005 to 0.5%,
B: 0.0005 to 0.015%,
Te: 0.0003 to 0.2%,
Bi: 0.005 to 0.5%, and
Pb: 0.005 to 0.5%, and
in contents satisfying $37 \leq Al \times N \times 10^5 \leq 96$, and
a balance of Fe and unavoidable impurities,
total volume of MN precipitates of a circle-equivalent diameter exceeding 200 nm accounting for 20% or less of total volume of all AlN precipitates.

2. A hot-worked steel according to claim 1, wherein one or more of the optional elements are included in the composition, wherein the elements are selected from the group consisting of Ca: 0.0003 to 0.0015%,
Ti: 0.001 to 0.01%,
Nb: 0.005 to 0.2%,
W: 0.01 to 1.0%,
V: 0.01 to 1.0%,
Cr: 0.01 to 2.0%,
Mo: 0.01 to 1.0%,
Ni: 0.05 to 2.0%,
Cu: 0.01 to 2.0%,
Mg: 0.0001 to 0.0040%,
Zr: 0.0003 to 0.01%, and
REMs: 0.0001 to 0.015%.

3. A hot-worked steel according to claim 1 or 2, wherein one or more of the optional elements are included in the composition, wherein the elements are selected from the group consisting of Sn: 0.005 to 2.0%,
Zn: 0.0005 to 0.5%,
B: 0.0005 to 0.015%,
Te: 0.0003 to 0.2%,
Bi: 0.005 to 0.5%, and
Pb: 0.005 to 0.5%.

4. A hot-worked steel according to claim 1 or 2, wherein the content of C is 0.30 to 0.85 mass %.

5. A hot-worked steel according to claim 3, wherein the content of C is 0.30 to 0.85 mass %.

6. A hot-worked steel comprising, in mass %,

C: 0.23 to 0.85%,
Si: 0.01 to 1.5%,
Mn: 0.05 to 2.0%,
P: 0.005 to 0.2%,
S: 0.020 to 0.15%,
Al: 0.110 to 1.0%,
N: 0.016% or less,
and optionally one or more elements in the following ranges:
Ti: 0.001 to 0.01%, and
Zr: 0.0003 to 0.01%,
wherein the steel does not contain Sb, and
in contents satisfying $37 \leq Al \times N \times 10^5 \leq 96$, and
a balance of Fe and unavoidable impurities,
total volume of MN precipitates of a circle-equivalent diameter exceeding 200 nm accounting for 20% or less of total volume of all AlN precipitates.

7. A hot-worked steel according to claim 6, further comprising, in mass %, one or more elements selected from the group consisting of Ca: 0.0003 to 0.0015%,
Ti: 0.001 to 0.01%,
Nb: 0.005 to 0.2%,
W: 0.01 to 1.0%,
V: 0.01 to 1.0%,
Cr: 0.01 to 2.0%,
Mo: 0.01 to 1.0%,
Ni: 0.05 to 2.0%,
Cu: 0.01 to 2.0%,
Mg: 0.0001 to 0.0040%,
Zr: 0.0003 to 0.01%, and
REMs: 0.0001 to 0.015%.

8. A hot-worked steel according to claim 6 or 7, further comprising, in mass %, one or more elements selected from the group consisting of Sn: 0.005 to 2.0%,
Zn: 0.0005 to 0.5%,
B: 0.0005 to 0.015%,
Te: 0.0003 to 0.2%,
Bi: 0.005 to 0.5%, and
Pb: 0.005 to 0.5%.

9. A hot-worked steel according to claim 6 or 7, wherein the content of C is 0.30 to 0.85 mass %.

10. A hot-worked steel according to claim 8, wherein the content of C is 0.30 to 0.85 mass %.

* * * * *